US006793012B2

(12) United States Patent
Fang et al.

(10) Patent No.: US 6,793,012 B2
(45) Date of Patent: Sep. 21, 2004

(54) HEAT EXCHANGER

(75) Inventors: Lei Fang, West Lafayette, IN (US); Zaiqian Hu, Columbus, IN (US); Pascal Bonnet, Fishers, IN (US); Jason W. McKittrick, Holton, IN (US); Jay Lorentz, Shelbyville, IN (US); David W. Baylor, Indianapolis, IN (US); Daniel R. Domen, Rochester Hills, MI (US)

(73) Assignee: Valeo, Inc, Auburn Hills, MI (US)

( * ) Notice: Subject to any disclaimer, the term of this patent is extended or adjusted under 35 U.S.C. 154(b) by 0 days.

(21) Appl. No.: 10/140,899

(22) Filed: May 7, 2002

(65) Prior Publication Data

US 2003/0209344 A1 Nov. 13, 2003

(51) Int. Cl.[7] ..... F28D 7/10
(52) U.S. Cl. ..... 165/140; 165/283; 165/174
(58) Field of Search ..... 165/140, 174, 165/153, 916, 283, 297

(56) References Cited

U.S. PATENT DOCUMENTS

| | | | | |
|---|---|---|---|---|
| 2,037,845 A | | 4/1936 | Young | |
| 2,505,790 A | * | 5/1950 | Panthofer | 165/140 |
| 3,300,135 A | | 1/1967 | Slater et al. | |
| 3,554,440 A | | 1/1971 | Austin et al. | |
| 3,818,981 A | * | 6/1974 | Caldwell | 165/297 |
| 3,920,067 A | * | 11/1975 | Schindler et al. | 165/283 |
| 4,669,532 A | | 6/1987 | Tejima et al. | |
| 4,998,580 A | | 3/1991 | Guntly et al. | |
| 5,036,911 A | | 8/1991 | So et al. | |
| 5,526,873 A | * | 6/1996 | Marsais et al. | 165/51 |
| 5,575,329 A | | 11/1996 | So et al. | |
| 6,082,447 A | | 7/2000 | Insalaco et al. | |
| 6,119,340 A | | 9/2000 | Insalaco et al. | |
| 6,158,500 A | | 12/2000 | Heine | |
| 6,161,614 A | * | 12/2000 | Woodhull et al. | 165/149 |
| 6,253,837 B1 | * | 7/2001 | Seiler et al. | 165/103 |
| 6,394,176 B1 | * | 5/2002 | Marsais | 165/140 |

FOREIGN PATENT DOCUMENTS

| | | |
|---|---|---|
| DE | 195 36 116 A1 | 4/1997 |
| EP | 0 789 213 A2 | 8/1997 |
| EP | 0 789 213 A3 | 6/1998 |
| EP | 0 851 198 A2 | 7/1998 |
| EP | 1 003 005 A1 | 5/2000 |
| EP | 0 851 198 B1 | 3/2003 |
| JP | 59-205591 | 11/1984 |
| JP | 63-197887 | 8/1988 |
| JP | 2-230091 | 9/1990 |
| JP | 3-79085 | 8/1991 |
| JP | 4-369396 | 12/1992 |
| JP | 7-17964 | 4/1995 |
| JP | 2001-174190 | 6/2001 |
| WO | WO 03/069251 A1 | 8/2003 |

OTHER PUBLICATIONS

Copending application Ser.No. 60/355,903 filed Feb. 11, 2002.
International Search Report for application Ser. No. PCT/US03/13942 dated Aug. 29, 2003.
Partial International Search Report for application Ser.No. PCT/US0313955 dated Aug. 22, 2003.
International Search Report for application Ser. No. PCT/US03/13254.
Copending application Ser. No. 10/425,348 filed Apr. 30, 2003.

* cited by examiner

*Primary Examiner*—Terrell McKinnon
(74) *Attorney, Agent, or Firm*—Dobrusin & Thennisch PC

(57) ABSTRACT

An improved heat exchanger for an automotive vehicle, comprising at least one end tank; and at least two heat exchangers including a plurality of spaced apart extruded metal tubes with fins between the spaced tubes. The heat exchangers are disposed so that their respective tubes and fins are generally co-planar with each other and are connected to the end tank. In preferred embodiments, the heat exchanger may include a bypass element.

51 Claims, 11 Drawing Sheets

HEAT EXCHANGER

FIELD OF THE INVENTION

The present invention relates generally to a heat exchanger and a method of forming the heat exchanger, and particularly, a multi-fluid heat exchanger.

BACKGROUND OF THE INVENTION

It has become increasingly desirable for heat exchangers to exhibit efficient transfer of heat, while remaining relatively easy to make. In the automotive industry, in particular, it has become increasingly necessary to combine multiple functions in a single heat exchanger assembly. In particular, the need to reduce the number of overall components, and to optimize assembly efficiency has driven the need for improved heat exchanger devices that combine increasingly efficient designs and multiple functions in packaging heretofore attainable using plural separate components or devices having inefficient designs. More specifically, there has been a growing need for an improved heat exchanger device, particularly for under the hood automotive vehicle applications, which combines multiple functions in a single assembly that is efficient to make and operate and that occupies substantially the same or less space than existing heat exchanger devices.

Particularly in extreme operating conditions and where a multi-fluid heat exchanger is to be employed, it is also attractive to be able to selectively manage heat exchange between the different fluids, especially when the different fluids passed through the heat exchanger have substantially different flow characteristics.

SUMMARY OF THE INVENTION

The present invention meets the above needs by providing an improved heat exchanger comprising a first end tank; a second end tank opposite the first end tank; a plurality of first tubes in fluid communication with the first and second end tanks, the plurality of first tubes adapted to have a first fluid flow there-through; a plurality of second tubes in fluid communication with the first and second end tanks, the plurality of second tubes adapted to have a second fluid, different from the first fluid, flow there-through; and a plurality of fins disposed between the first and second tubes, with the first and second tubes and the fins being generally co-planar relative to each other.

In another aspect the present invention is directed to a heat exchanger comprising a first end tank; a second end tank opposite the first end tank; a plurality of first extruded metal tubes in fluid communication with the first and second end tanks, and being adapted to have a first fluid flow there-through; a plurality of second extruded metal tubes in fluid communication with the first and second end tanks, and being adapted to have a second fluid, different from the first fluid, flow there-through; and a plurality of fins disposed between the first and second tubes, with the first and second tubes and the fins being generally co-planar relative to each other; wherein at least one of the first or second extruded metal tubes includes an interior wall structure including a partition adapted for subdividing the tube into a plurality of passageways within the tube.

In yet another aspect of the present invention, there is contemplated an improved heat exchanger, comprising a first end tank; a second end tank opposite the first end tank; a plurality of first tubes in fluid communication with the first and second end tanks, the plurality of first tubes adapted to have a first fluid flow there-through, and including a first end tube defining one end of the heat exchanger; a plurality of second tubes in fluid communication with the first and second end tanks, the plurality of second tubes adapted to have a first fluid flow there-through, and including a second end tube defining one end of the heat exchanger; and a plurality of fins disposed between the first and second tubes, with the first and second tubes and the fins being generally co-planar relative to each other; wherein the heat exchanger includes no more than one end plate.

In yet another aspect of the present invention, there is contemplated a heat exchanger comprising at least one end tank divided into a first portion and a second portion by a baffle; a plurality of first tubes having a plurality of arcuate edges, in fluid communication with the first portion of the end tank, and adapted for having a first fluid flow there-through; a plurality of second tubes each having a plurality of arcuate edges, in fluid communication with the second portion of the end tank, and adapted for having a second fluid flow there-through; and a plurality of fins disposed between the first and second tubes and including a plurality of projections for opposing the pluralities of arcuate edges of the tubes and providing stability of the tubes relative to the fins during assembly.

In one particularly preferred embodiment, the present invention contemplates a heat exchanger for an automotive vehicle, comprising at least one end tank; and at least two heat exchangers including a plurality of spaced apart extruded metal tubes with fins between the spaced tubes; the heat exchangers being disposed so that their respective tubes and fins are generally co-planar with each other and are connected to the end tank; and the heat exchangers being selected from the group consisting of a transmission oil heat exchanger, a power steering oil heat exchanger, a condenser or combinations thereof.

Another highly preferred embodiment a ratio of the length to the hydraulic diameter of heat exchanger tubes in at least one of the heat exchangers is between about 80 and about 1820 and more preferably about 300 and about 700. For example, the length of tubes can be between about 200 mm to about 1000 and the hydraulic diameter is between about 0.55 to about 2.50 mm.

In yet another preferred embodiment, the invention is directed to an improved heat exchanger assembly, comprising a first heat exchanger; a second heat exchanger in generally co-planar relationship with the first heat exchanger; at least one end tank divided into an inlet portion and an outlet portion for the first heat exchanger, and being connected in fluid communication to both the first heat exchanger and the second heat exchanger; an inlet in fluid communication with the inlet portion of the first end tank; an outlet in fluid communication with the outlet portion of the first end tank; a plurality of heat exchanger tubes adapted for fluid flow therethrough in a first flow circuit, at least one of the plurality of tubes in fluid communication with the inlet portion and a least one other of the plurality of tubes in fluid communication with the outlet portion; and a bypass element located on the exterior of the end tank and being adapted for providing a passageway at an intermediate location within the first flow circuit adapted for, at relatively low operating temperatures, intercepting a fluid in the first flow circuit to divert the fluid so that it avoids passing through the entire first flow circuit.

In still another preferred embodiment, the bypass element is located external of the end tank and is particularly adapted for providing a passageway at an intermediate location within the first flow circuit adapted for inducing a first pressure gradient, at relatively low operating temperatures, and intercepting a fluid in the first flow circuit to divert the fluid so that it avoids passing through the entire first flow circuit. Thus, one preferred structure for a bypass element herein includes a first passageway that is part of the inlet, a second passageway that is part of the outlet, and a third passageway joining the first passageway and the second passageway.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF THE PREFERRED EMBODIMENT

Figure 1:
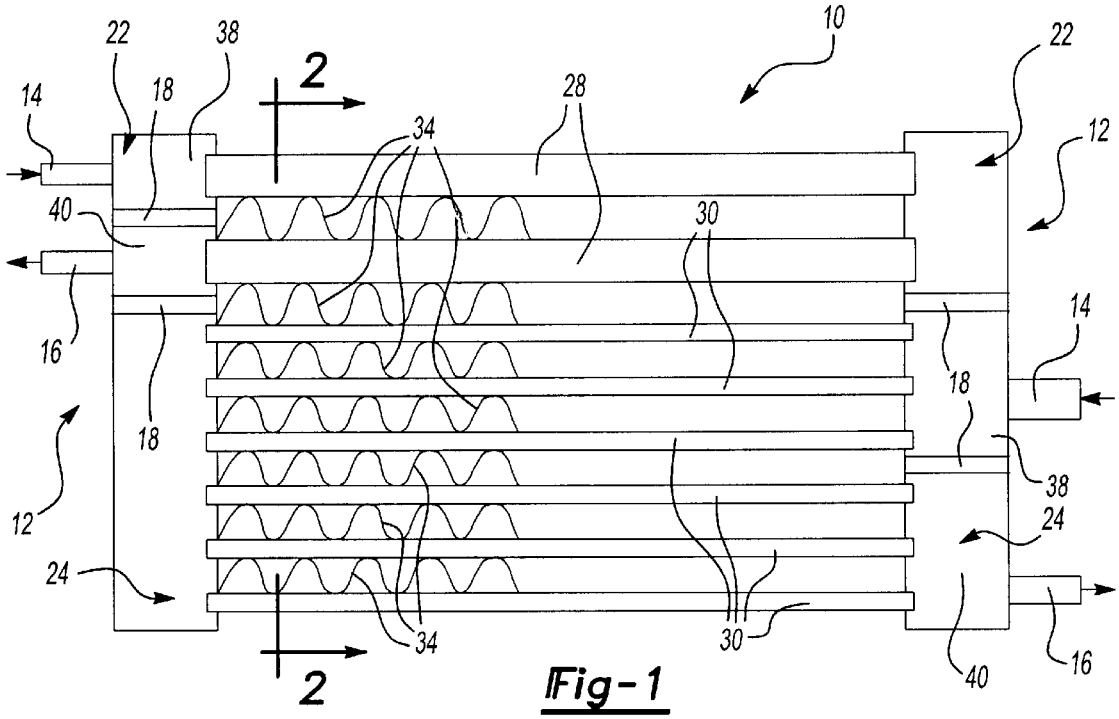
FIG. 1 is an elevational view of an exemplary heat exchanger in accordance with an aspect of the present invention.

Generally, the present invention relates to a heat exchanger and to a method of forming the heat exchanger. The heat exchanger may be a single fluid or multi-fluid (e.g., 2, 3 or 4 fluid) heat exchanger. The heat exchanger may also be a single pass or multi-pass heat exchanger. Although the heat exchanger according to the present invention may be used for a variety of articles of manufacture (e.g., air conditioners, refrigerators or the like), the heat exchanger has been found particularly advantageous for use in automotive vehicles. For example, the heat exchanger may be used for heat transfer of one or more various fluids within a vehicle such as air, oil, transmission oil, power steering oil, radiator fluid, refrigerant, combinations thereof or the like. For example, in a highly preferred embodiment of the present invention there is contemplated a multi-fluid heat exchanger that includes a condenser in combination with an oil cooler selected from the group consisting of a power steering oil cooler, a transmission oil cooler and a combination thereof.

According to one preferred aspect of the invention, the heat exchanger provides an improved multi-fluid heat exchanger having features permitting for ease of assembly of the heat exchanger, and particularly provides an improved tube and fin assembly structure and process, wherein fin edges are particularly configured for improving assembly efficiency. According to another preferred aspect, the heat exchanger is optimized for performance by careful selection of such design criteria as hydraulic diameter, tube configuration or a combination thereof. According to still another preferred aspect, the heat exchanger includes improved protective features including end plates, end tubes or the like.

The heat exchanger may be installed in a variety of locations relative the article of manufacture to which the heat exchanger is applied. For an automotive vehicle, the heat exchanger is preferably located under a hood of the vehicle. According to one highly preferred embodiment, the heat exchanger may be attached to a radiator of the vehicle. Exemplary methods and assemblies for attaching a heat exchanger to a radiator are disclosed in U.S. Pat. No. 6,158,500 and co-pending U.S. provisional patent application serial No. 60/355,903, titled "A Method and Assembly for Attaching Heat Exchangers", filed on Feb. 11, 2002 both of which are fully incorporated herein by reference for all purposes.

According to one aspect of the invention, the heat exchanger will comprise a plurality of components that are assembled together by suitable joining techniques. In one preferred embodiment, one or more of the components of the heat exchanger such as the baffles, the end tanks, the tubes, fins, the inlets, the outlets, a bypass or combinations thereof may be attached to each other using brazing techniques. Although various brazing techniques may be used, one preferred technique is referred to as controlled atmosphere brazing. Controlled atmosphere brazing typically employs a brazing alloy for attaching components wherein the components are formed of materials with higher melting points than the brazing alloy. The brazing alloy is preferably positioned between components or surfaces of components to be joined and, subsequently, the brazing alloy is heated and melted (e.g., in an oven or furnace, and preferably under a controlled atmosphere). Upon cooling, the brazing alloy preferably forms a metallurgical bond with the components for attaching the components to each other. According to one highly preferred embodiment, the brazing alloy may be provided as a cladding on one of the components of the heat exchanger. In such a situation, it is contemplated that the components may be formed of a material such as a higher melting point aluminum alloy while the cladding may be formed of a lower melting point aluminum alloy.

Heat exchangers of the present invention will typically include one or more tubes, one or more end tanks, one or more inlets and outlets, one or more baffles, one or more fins or a combination thereof. Depending upon the embodiment of the heat exchanger, various different shapes and configurations are contemplated for the components of the heat exchanger. For example, and without limitation, the components may be integral with each other or they may be separate. The shapes and sizes of the components may be varied as needed or desired for various embodiments of the heat exchanger. Additional variations will become apparent upon reading of the following description.

In general, a preferred heat exchanger contemplates at least two spaced apart end tanks bridged together in at least partial fluid communication by a plurality generally parallel tubes, with fins disposed between the tubes. Optional end plates, or more preferably, end tubes enclose the assembly in a generally co-planar configuration.

More specifically, referring to FIG. 1, there is illustrated a heat exchanger 10 according to one preferred aspect of the present invention. The heat exchanger 10 includes a pair of end tanks 12. Each of the end tanks includes or supports an inlet 14, an outlet 16 and baffles 18. Of course, it is also possible to locate all inlets, outlets and baffles in only one of the end tanks. Additionally, each of the end tanks 12 includes a first tank portion 22 separated from a second portion 24 by at least one of the baffles 18. The heat exchanger 10 also includes a plurality of tubes 28, 30 extending between the end tanks 12. Preferably, the tubes 28, 30 are separated from each other by fins 34.

Depending upon the configuration of the heat exchanger, it may be possible to provide common end tanks that are divided to accommodate more than one fluid or separate end tanks for accommodating plural fluids. It is also possible that end plates can be employed to bridge the end tanks in accordance with the present invention. However, it is particularly preferred that the heat exchanger employs end tubes in lieu of end plates. In this manner, weight savings and improved efficiency is possible owing to a reduced variety of component types.

As mentioned, one advantageous feature of the present invention is the ability to integrate a plurality of different fluid heat exchangers. Though the specification will make apparent that alternatives are possible (e.g. side by side) one particularly preferred approach is to effectively stack a first fluid heat exchanger upon at least a second fluid heat exchanger in a single generally co-planar assembly.

Figure 2:
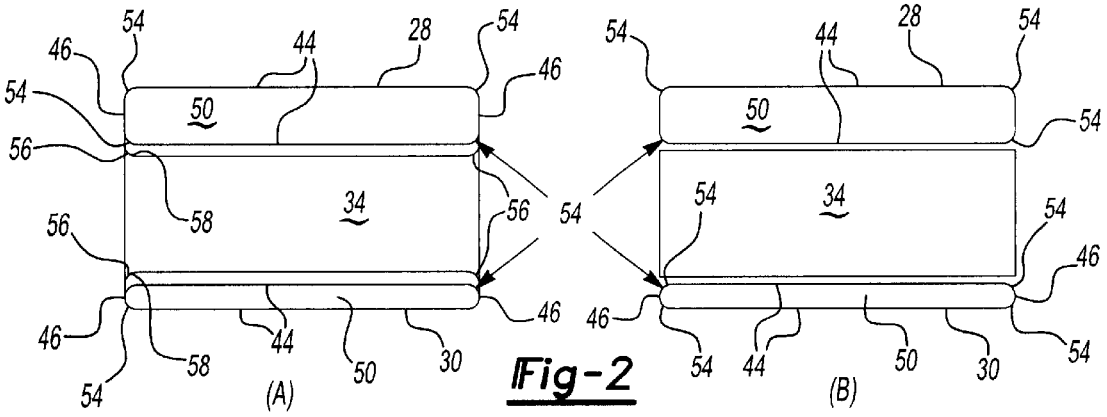
FIG. 2 illustrates sectional views of alternative embodiments of a tube and fin assembly.

In the preferred embodiment shown, the heat exchanger 10 includes a plurality of a first set of tubes 28 extending between and in fluid communication with a first portion 22 (e.g. an upper portion) of the end tanks 12 and a plurality of a second set of tubes 30 in fluid communication with the second portion 24 (e.g. a lower portion) of the end tanks 12. Moreover, the first portion 22 of one of the end tanks 12 and the second portion 24 of the other of the end tanks 12 are separated into an inlet portion 38 in fluid communication with one of the inlets 14 of the heat exchanger 10 and an outlet portion 40 in fluid communication with one of the outlets 16 of the heat exchanger 10. Preferably, as shown best in FIG. 2, the first and second tubes 28, 30 include body walls 44, which are of similar size and shape. However, the first set of tubes 28 preferably include side walls 46 that are substantially larger than corresponding side walls 46 of the second set of tubes 30 such that passageways 50 of the first set of tubes 28 are substantially larger than passageways of the second set of tubes 30.

The heat exchanger 10 is formed by attaching the tubes 28, 30 to the end tanks 22 either sequentially or simultaneously with one or more fins 34 between each of the opposing tubes 28, 30. The tubes 28, 30 may be attached to the end tanks with fasteners (mating or otherwise), by welding, brazing or the like. Additionally, the fins 34 may be attached or fastened to the tubes 28, 30, the end tanks 22 or both.

In a highly preferred embodiment, although not required, the tubes 28, 30 may be formed with arcuate edges 54 connecting the body walls 44 and side walls 46 of the tubes 28, 30. The arcuate edges 54 may be separate from or may form at least part of the body and side walls 44, 46 of the tubes 28, 30. In the preferred embodiment shown, the radius of curvature for each of the arcuate edges 54 is substantially identical. However, the radius may vary from edge to edge. Also in the highly preferred embodiment, the fins 34 are formed with edge projections 56, such as is shown in FIG. 2A. In this manner, the fins are adapted for providing a drop resistant structure that helps retain the fins 34 stable relative to the tubes 28, 30 particularly during assembly (e.g. during a brazing operation). In the preferred embodiment shown, the projections 56 include a surface 58 configured to generally overlap and complement the arcuate edges 54 of the tubes 28, 30. It is contemplated that each fin 34 may include one or a plurality of edge projections 56. For example, as illustrated, there are four projections 56. However, it will be appreciated that fewer may be employed provided that stability of fins relative to tubes can be maintained.

Advantageously, the substantially identically configured body walls 44 and the substantially identical radius of curvature of the edges 54 allows at least one of the larger upper tubes 28 to be separated from at least one of the smaller lower tubes 28, 30 by fins 34 that are substantially identical to the fins 34 separating the lower tubes 28 from each other, the fins 34 separating the upper tubes 28 from each other or both. Thus, in one highly preferred embodiment, each of the tubes 28, 30 is separated from each opposing tube by only one fin 34 and each of the fins 34 is substantially the same size, shape or a combination thereof. Fin size or shape, however, may vary from fin to fin also.

In operation, a first fluid enters through the inlet 14 of the inlet portion 38 of a first of the end tanks 12 and flows through passageways 50 of one or more of the first set of tubes 28 to a first portion of a second of the end tanks 12. Thereafter, the first fluid flows through another passageway 50 of one or more of the first set of tubes 28 to the outlet portion 40 and through the outlet 16. Additionally, a second fluid enters the heat exchanger through the inlet 14 of the inlet portion 38 of the second portion 24 of the second of the end tanks 12 and flows through passageways 50 of the second set of tubes 28. The second fluid flows through the outlet 16 of the second portion 24 of the second of the end tanks 12. Of course, as discussed previously, the functions of both of the end tanks can be integrated into a single end tank.

During flow of the first and second fluids through the tubes 28, 30, an ambient fluid preferably flows by over outside of the tubes 28, 30, the fins 34 or both. In turn, heat may be transferred from the first and second fluids to the ambient fluid or from the ambient fluid to the first and second fluids. The first and second fluids may be of the same or a different viscosity. For example, in one preferred embodiment, the first fluid has a higher viscosity than the second fluid. For example, and without limitation, the first fluid may be transmission oil, coolant oil, engine oil, power steering oil or the like while the second fluid will typically be a refrigerant.

Advantageously, if and when different sized tubes are employed, the larger passageways 50 of the first set of tubes 28 are suitable for the flow of more viscous fluids without relatively large pressure drops across the tubes 28 while the smaller passageways 50 of the lower tubes are suitable for lower viscosity fluids. It is also possible to switch the positioning of the tubes so that the first fluid is passed through the second portion or vice versa.

From the above, it will thus be appreciated that one preferred method of the present invention contemplates providing a multi-fluid heat exchanger assembled in a common assembly; passing a first fluid through one portion of the heat exchanger for heat exchange, and passing at least one additional fluid through at least one additional portion of the heat exchanger for heat exchange of the additional fluid.

It is contemplated that a heat exchanger formed in accordance with the present invention may include one or more tubes having various different internal configurations for defining passageways within the tubes. They may also have different external configurations defining one or more outer peripheral surfaces of the tubes. Further it is possible that the internal configurations, external configuration or both vary along the length of the tube.

The internal configuration of a tube may be the same or different from the external configuration. For instance, the walls of the tubes may have opposing sides that are generally parallel to or otherwise complement each other. Alternatively, they may have a different structure relative to each other. The external configuration of the tube may include grooves, ridges, bosses, or other structure along some or all of its length for assisting in heat transfer. Likewise, the internal configuration may include grooves, ridges, bosses or other structure.

It is also possible that the structure is provided for generating turbulence within the fluid, or for otherwise controlling the nature of the flow of fluid there-through.

The passageways of the tubes may be provided in a variety of shapes such as square, rectangular, circular, elliptical, irregular or the like. In preferred embodiments, the passageways of tubes may include one or more partitions, fins or the like. As used herein, a partition for a passageway in a tube is a structure (e.g., a wall) that substantially divides at least part of the passageway into a first and second portion. The partition preferably is continuous (but may be non-continuous) such that the partition completely separates the first portion from the second portion or the partition may include openings (e.g., through-holes, gaps or the like) connecting the first and second portion.

As used herein, a fin for a passageway in a tube is intended to encompass nearly any structure (e.g. a protrusion, a coil, a member or the like), which is located within the passageway of the tube and is physically connected (e.g., directly or indirectly) to an outer surface of the tube that engages in heat exchange. The shape of each of the fins may be the same or different relative to each other. Further, the pitch angle of each fin may be the same or different relative to each other. It will also be appreciated that the configuration of a tube may vary along its length. One or both tube ends may be provided with fins but the central portion left un-finned. Likewise, the central portion may be provided with fins but one or both of the tube ends are left un-finned. Fin spacing may be constant within a passageway or may be varied as desired.

It is contemplated that various numbers of partitions and fins may be used depending upon the size, shape, configuration or the like of the passageways, tubes or both. The fins may be any desirable shape, for instance they may have a sectional profile that is triangular (e.g. as shown as 80 in FIG. 3A), rectangular, rounded or the like. Preferably, the partitions can divide the passageways into various numbers of portions of various different sizes and shapes or of substantially equivalent sizes and shapes. As examples, the portions may be contoured, straight, rectangular or otherwise configured.

Figure 3A:
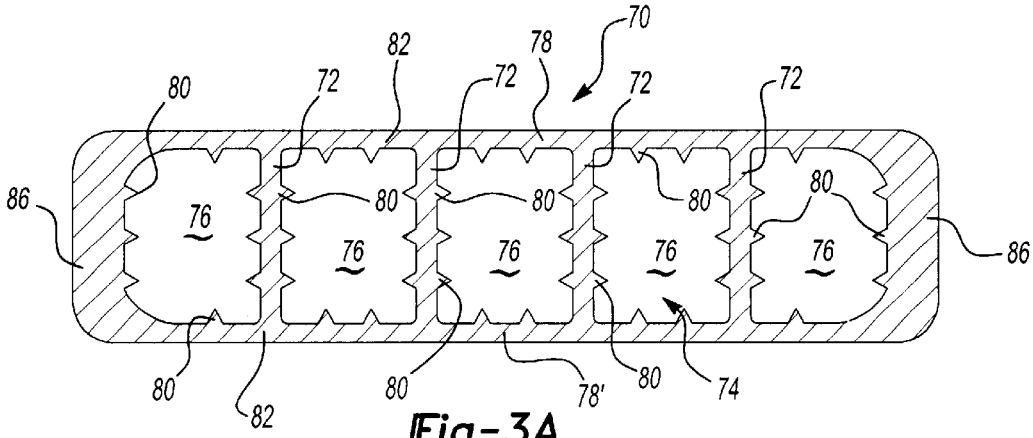
FIGS. 3(A)–3(G) are sectional views of alternative embodiments of tubes suitable for use in the heat exchanger of the present invention.

Referring to FIG. 3(A), a tube 70 is illustrated having a plurality of substantially identical partitions 72 (e.g., four partitions) dividing the passageway 74 of the tube 70 into a plurality of substantially identically sized portions 76 (e.g., five portions). As shown, each of the partitions 72 is substantially vertical and extends from a first body wall 78 to a second opposing body wall 78' and each of the portions 76 is substantially rectangular. Additionally, each of the partitions 72 includes a plurality of fins 80 (e.g., three fins) extending into each portion 76 of the passageway 74, along at least a portion of the length of the passageway. Moreover, one or a plurality of fins 80 (e.g., two, three or more fins) extend from each of a pair of opposing body walls 82 of the tube 70 into each portion 76 of the passageway 74 and a plurality of fins 80 (e.g., three fins) extend from a pair of opposing side walls 86 into each of a pair of the portions 76 on opposite ends of the tube 70. In the embodiment, depicted, each of the fins 80 is generally triangular in cross-section.

For certain applications, and particularly for lower viscosity fluids, it can be advantageous to have substantially equally sized passageways such that flow through each of the passageway is substantially equivalent and promotes higher amounts of heat transfer. In alternative embodiments, a tube may be divided into one or more of a plurality of first passageways having a first sectional area and one or a plurality of second passage ways having a second sectional area (e.g. larger, smaller of different shape relative to the first passageways). Additionally, the partitions of the tube may extend horizontally, vertically, diagonally, combinations thereof or otherwise.

Figure 3B:
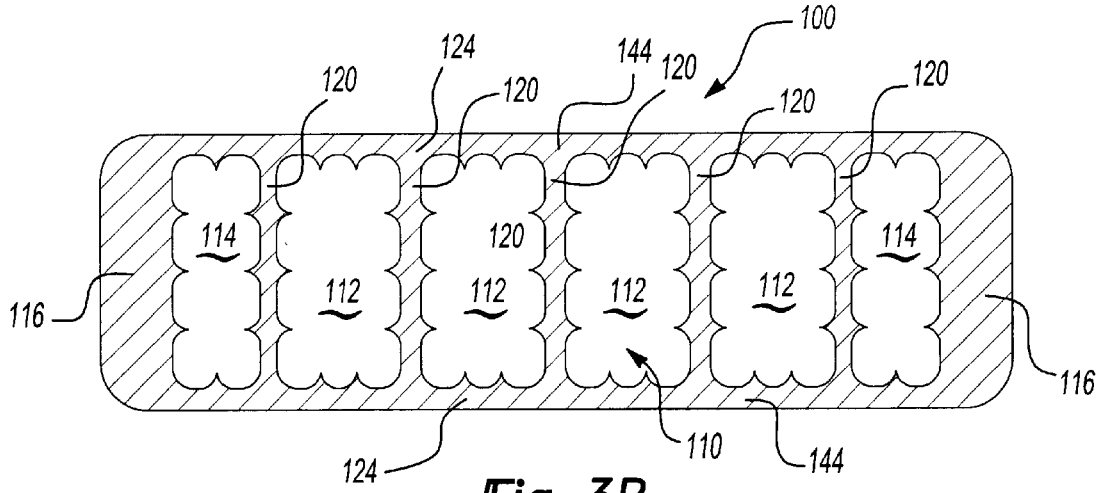
Figure 3C:
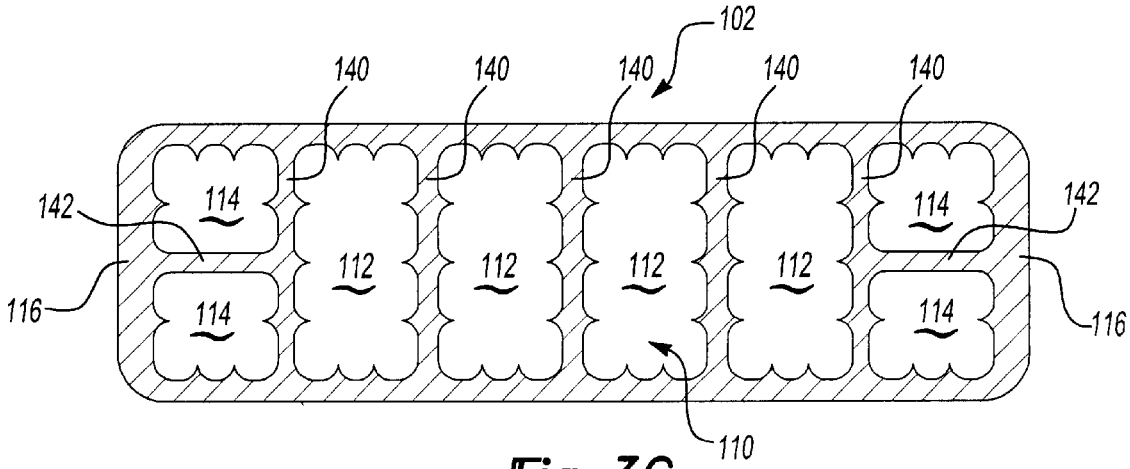
Figure 3D:
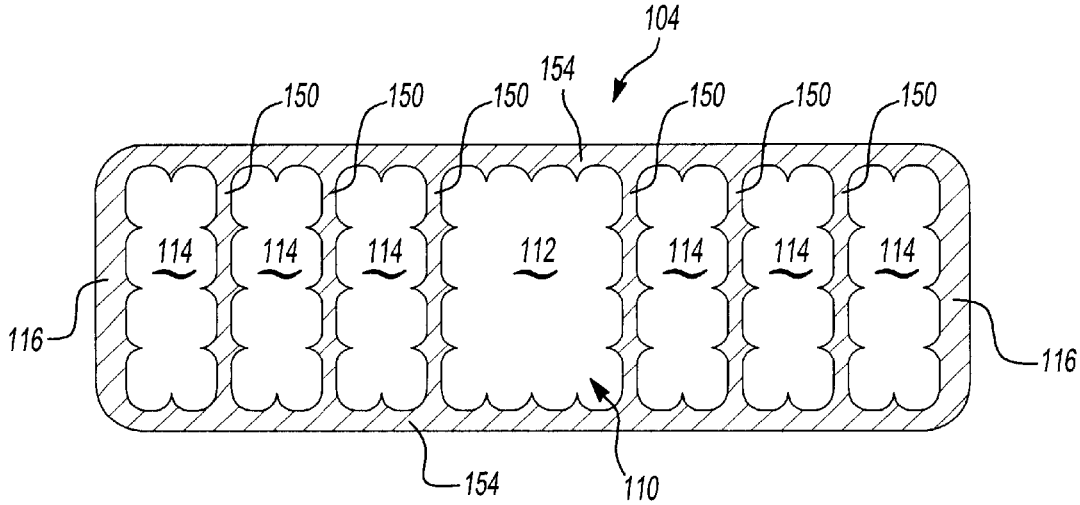

By way of illustration, referring to FIGS. 3(B)–3(D), there are respectively illustrated three tubes 100, 102, 104. Each of the tubes 100–104 includes a passageway 110, which is divided into one or more larger portions 112 (i.e., sub-passageways) and one or more smaller portions 114 (i.e., sub-passageways). In the embodiments shown, the larger portions 112 are located more centrally within the tubes 100–104 while the smaller portions 114 are located toward sides or side walls 116 of the tubes 100–104 although such an arrangement is not required and may be reversed. Each of the tubes 100–104 also includes a plurality of fins extending into the smaller and larger portions.

In FIG. 3(*b*), the tube 100 includes a plurality of partitions 120 (e.g., five partitions), which are shown as substantially vertical and extending from one body wall 124 through the passageway 110 to an opposing body wall 124. The partitions 120 divide the passageway 110 into a plurality of the relatively larger portions 112 (e.g., four larger sub-passageways) and a plurality of the relatively smaller portions 114 (e.g., two smaller sub-passageways). As shown, the larger portions 112 are generally centrally located and rectangular in shape while the smaller portions 114 are generally located near the sides 116 of the tube 100, but are also generally rectangular in shape.

In FIG. 3(*c*), the tube 102 includes a plurality of partitions 140, 142 (e.g., seven partitions). One group of the partitions 140 (e.g., five of the partitions) is shown as substantially vertical and extending from one body wall 144 through the passageway 110 to an opposing body wall 144. Another group of the partitions 142 (e.g., two partitions) is shown as substantially horizontal and extending from the side walls 116 to the nearest partition 140 of the other group. The partitions 140, 142 divide the passageway 110 into a plurality of the relatively larger portions 112 (e.g., four larger sub-passageways) and a plurality of the relatively smaller portions 114 (e.g., four smaller sub-passageways). As shown, the larger portions 112 are generally centrally located and rectangular in shape while the smaller portions 114 are generally located near the sides 116 of the tube 100 and are generally square in shape.

In FIG. 3(*d*), the tube 104 includes a plurality of partitions 150 (e.g., five partitions), which are shown as substantially vertical and extending from one body wall 154 through the passageway 110 to an opposing body wall 154. The partitions 150 divide the passageway 110 into one relatively larger portion 112 and a plurality of the relatively smaller portions 114 (e.g., six smaller sub-passageways). As shown, the larger portion 112 is generally centrally located and square in shape while the smaller portions 114 are generally located nearer the sides 116 of the tube 100 and are generally rectangular in shape.

Advantageously, tubes with passageways divided into larger and smaller sub-passageways, such as those above, have the ability to effectively perform a passive bypass function particularly for the cooling of relatively high viscosity fluids flowing through the tubes. In particular, a higher viscosity fluid will typically be more viscous at lower temperatures and, consequently, more of the fluid will flow through the larger sub-passageways and bypass the smaller sub-passageways resulting in less heat transfer from the fluid. In contrast, as the temperature of the fluid elevates, the fluid will become less viscous and, consequently, the rate will increase at which the fluid is able to flow through the smaller sub-passageways. Thus, the diverse passageway structure tube facilitates, flow of the high viscosity fluid through the tube at cooler temperatures.

In other alternative embodiments, surfaces defining the internal portions of any of the internal passageways of the tubes may be smooth or planar or may be contoured such as corrugated (e.g., including several patterned ridges), ribbed (i.e., including several protrusions), dimpled (e.g., including several depressions) or another suitable fin structure. Spiral or helical grooves or ridges may be provided. In still other alternative embodiment, the tubes may include one or more internal inserts, which are fabricated separately from the tubes but subsequently assembled together. It is contemplated that inserts may be formed in a variety of configurations and shapes for insertion into passageways or portions of passageways of tubes. For example, and without limitation, inserts may be members (e.g., straight or contoured members) with complex or simple configurations. Alternatively, inserts may be coils, springs or the like.

Figure 3E:
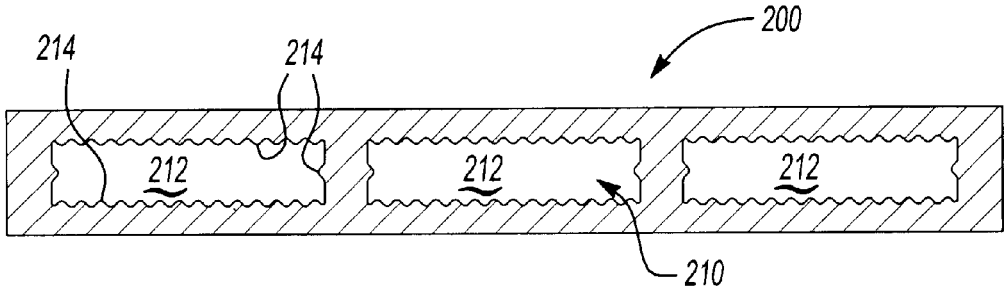
Figure 3F:
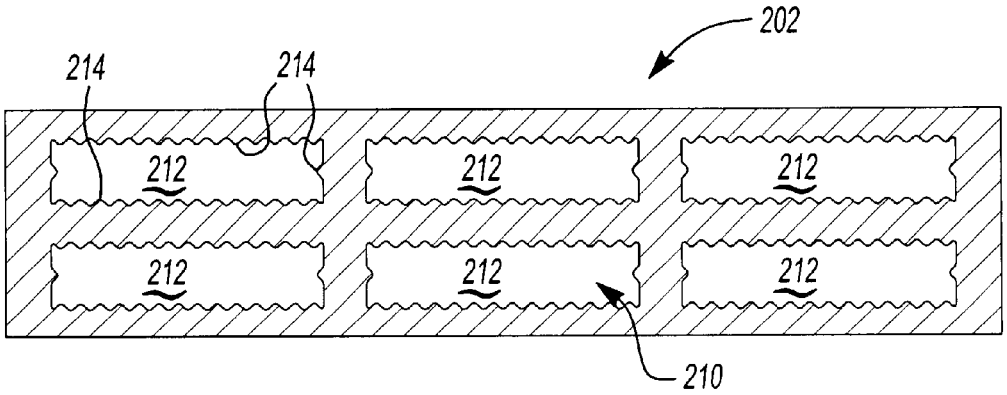

Referring to FIGS. 3(E)–3(F), there are respectively illustrated two tubes 200, 202 according to preferred embodiments of the invention. Each of the tubes 200–202 includes a passageway 210, which is divided into a plurality of sub-passageways 212 and each of the sub-passageways 212 is defined by one or more interior wall surfaces 214. In the embodiments shown, the wall surfaces 214 are contoured, and in particular, the surfaces 214 are corrugated.

As shown, each of the sub-passageways 212 is generally rectangular in shape with a finned interior wall surface 214 defining the sub-passageways 212. However, the geometric configuration of the portions 212 is nearly limitless and could be, for example, square, circular, elliptical, irregular or the like. In FIG. 3(E), the tube 200 includes a plurality of sub-passageways 212 (e.g., three) side by side. In FIG. 3(F), the tube 202 includes a plurality of sub-passageways (e.g., six) which are stacked atop one another in groups (e.g., groups of two) and the groups are arranged in a side by side configuration.

Figure 3G:
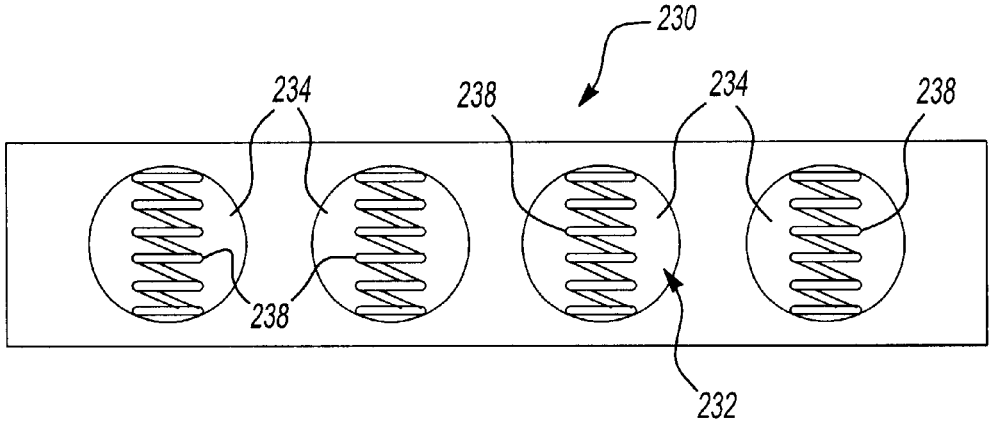

Referring to FIG. 3(G), there is illustrated a tube 230 having a passageway 232 divided into a plurality of sub-passageways 234 wherein inserts 238 have been placed within each of the portions 234. In the embodiment shown, the sectional geometry of the sub-passageway 234 are substantially circular and the inserts 236 are springs, which may be compressed and inserted within the portions 234 or passageway 232.

Formation of tubes according to the present invention may be accomplished using several different protocols and techniques. As examples, tubes may be drawn, rolled, cast or otherwise formed. Additionally, tubes according to the present invention may be formed of a variety of materials including plastics, metals, other formable materials or the like. Preferably, however, the tubes are a metal selected from copper, copper alloys, low carbon steel, stainless steel, aluminum alloys, titanium alloys or the like. The tubes may be coated or otherwise surface treated over some or all of its length for locally varying the desired property.

In a highly preferred embodiment, the tubes are formed by extrusion of aluminum. In the embodiments shown in FIGS. 3(A)–3(G), each of the tubes has a substantially continuous cross-section, which is the cross-section shown in those figures. Thus, extrusion dies (not shown) having configurations corresponding to the cross-sections of the tubes may be used to shape aluminum extrudate to have the cross-sections shown and the extrudate may be cut or otherwise divided to form the tubes.

As suggested previously, it is contemplated that tubes of the present invention may have various numbers of partitions dividing the passageways of the tubes into various numbers of portions. According to one preferred aspect, however, a preferred methodology is employed for establishing certain design parameter, such as choosing or setting the number of partitions, the number of portions, the size of the portions, the size of the passageways or a combination thereof.

Generally, the methodology includes the employment of one or more experimental tubes capable of providing a variety of predetermined hydraulic diameters. Preferably, the tubes have substantially the same length although not required. Thereafter, pressure drops and heat transfers for each of the predetermined hydraulic diameters are experimentally determined. Then, a desired hydraulic diameter or range of hydraulic diameters are determined for the values of pressure drop and heat transfer. Lastly, one or more design parameters are established by setting the one or more design parameters for a tube such that the tube exhibits the desired hydraulic diameter or a hydraulic diameter in the range of desired hydraulic diameters.

According to a preferred embodiment of the methodology, parameters are chosen by determining a desired hydraulic diameter or range thereof for one or more tubes of a particular length such that the parameters may be set to provide the desired hydraulic diameter. As used herein, hydraulic diameter ($D_H$) is determined according to the following equation:

$$D_h=4A_P/P_w$$

wherein $A_p$=wetted cross-sectional are of the passageway of a tube; and $P_w$=wetted perimeter of the tube.

Each of the variables ($P_w$ and $A_p$) for hydraulic diameter ($H_d$) are determinable for a tube according to standard geometric and engineering principles and will depend upon the configuration of a particular tube and the aforementioned variables for that tube (i.e., the number of partitions, the number of portions, the size of the portions, the size of the passageways or a combination thereof).

According to the methodology, at least one experimental tube is provided. The at least one experimental tube may be one experimental tube having a predetermined length and a variable hydraulic diameter or a plurality of experimental tubes each having the same predetermined length, but a different hydraulic diameter. Thereafter, heat transfer and pressure drop for a fluid flowing through the at least one experimental tube are experimentally determined for a range of hydraulic diameters using sensors such as pressure gauges, temperature sensors or the like.

Figure 3H:
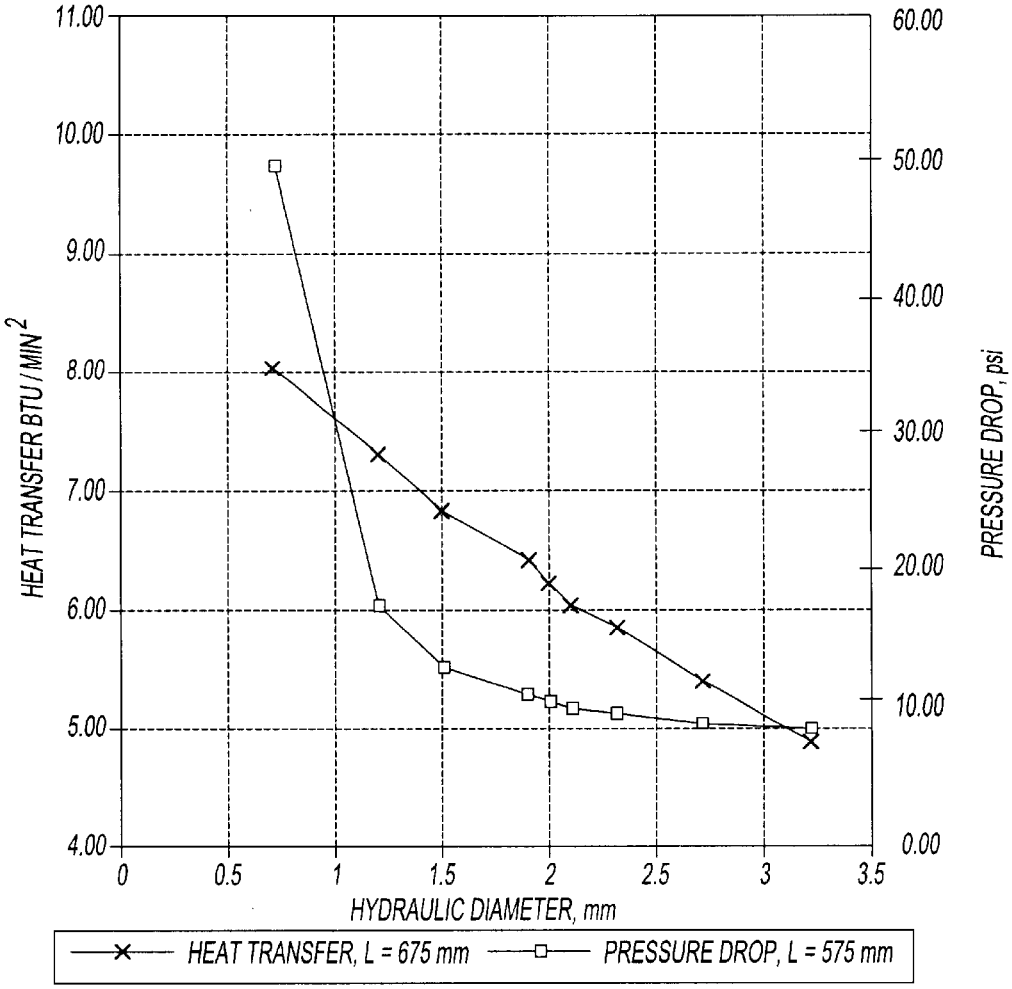
FIG. 3(H) is a graph showing heat exchange, hydraulic diameter and pressure drop for a tube of a heat exchanger.

As shown in FIG. 3(H), one or more of the values for pressure drop, heat transfer, and hydraulic diameter for a particular fluid and for a particular length of tube is plotted. As can be seen from the graph, as hydraulic diameters become smaller, less and less heat transfer is realized for larger and larger pressure drops. Consequently, a desired hydraulic diameter or a range of hydraulic diameters may be determined for which a maximum amount of heat transfer is acquired from the fluid for a minimum amount of pressure drop driving the flow of the fluid through the at least one tube. By way of example, a preferred range of hydraulic diameters for the data of FIG. 3(H) would be 1.2 mm to about 1.7 mm.

Thus, the number of partitions, number of sub-passageways, the size of the sub-passageway, fin size shape or location or the like may be varied and thereafter measured for providing the desired hydraulic diameter or a hydraulic diameter in the desired hydraulic diameter range for a predetermined length of tube. According to one preferred embodiment, the height of the internal fins and the width of the internal fins are between about 0.05 to about 0.25 times the hydraulic diameter. Thus, the height and width of a fin within a tube having a hydraulic diameter of 1.0 mm is about 0.05 mm to about 0.25 mm.

Various exemplary hydraulic diameter ranges are preferably determined for viscous fluids such as engine oil, transmission oil and power steering oil at around 23° C. As examples, preferred hydraulic diameters for oils flowing through tubes of between about 600 mm to about 750 mm in length are between about 1.10 mm and 1.90 mm. Preferred hydraulic diameters for oils flowing through tubes of between about 250 mm to about 350 mm in length are between about 0.55 to about 1.30 mm. Additionally, preferred hydraulic diameters for oils flowing through tubes of between about 850 mm and about 1000 mm in length are between about 1.20 to about 2.5 mm.

From the above lengths and diameters, preferred ratios ($R_{ld}$) for length of a tube to the hydraulic diameter of the tube have been determined for assisting in setting the hydraulic diameters of tubes transporting oils. Preferably, the ratio ($R_{ld}$) is between about 80 and about 1820, more preferably between about 300 and about 700 and still more preferably between about 400 and about 600.

For a multi-fluid heat exchanger, it may be desirable for the tubes designed to transport one of the fluids to be sized, dimensioned or both relative to the tubes that are designed to transport the other fluid[s]. In particular, for a multi-fluid heat exchanger designed to handle a first fluid such as a refrigerant and a second fluid such as an oil (e.g., transmission or power steering oil), it is desirable for the internal and external surface areas of the various tubes to be sized, dimensioned or both relative to each other to provide for greater amounts of heat transfer to and/or from the fluids.

According to a preferred aspect of the present invention, a multi-fluid heat exchanger includes tubes for transporting a first fluid such as a coolant fluid (e.g., a refrigerant or radiator fluid) and tubes for transporting a second fluid such as an oil (e.g., transmission oil, power steering oil or the like). For the tubes transporting the coolant fluid, a large amount of thermal resistance to heat exchange is produced at the external surface of the tube relative to any amount of thermal resistance produced at the internal surface of the tube. However, for the tubes transporting the oil, a large amount of thermal resistance is produced at the internal surface of the tube relative to the any amount of thermal resistance produced at the external surface of the tube. As a result, it is generally desirable for the tube transporting the coolant fluid to have a larger external surface area relative to its internal surface area while it is generally desirable for the tube transporting the oil to have a larger internal surface area relative to its external surface area.

For the tube transporting oil in the multi-fluid heat exchanger, it has been found that heat transfer from the oil is greater when the internal surface area per unit length ($S_{oil,internal}$) of the tube is greater than the external surface area per unit length ($S_{oil,external}$). Moreover, for a tube transporting the coolant fluid in the multi-fluid heat exchanger, it has been found that heat transfer from the coolant fluid is greater when the internal surface area per unit length ($S_{cooler,internal}$) of the tube is less than the external surface area per unit length ($S_{cooler,external}$). Thus, for the multi-fluid heat exchanger, a coolant tube surface area ratio ($R_{ci/ice}$) of internal surface area ($S_{cooler,internal}$) to external surface area ($S_{cooler,external}$) for the cooler fluid tube is preferably less than one. However, an oil tube surface area ratio ($R_{oi/oe}$) of internal surface area ($S_{oil,internal}$) to external surface area ($S_{oil,external}$) for the oil tube is preferably greater than one. Moreover, for the multi-fluid heat exchanger with the coolant tubes and the oil tubes, it has been found that an oil tube/cooler tube ratio ($R_{oc}$) of oil surface area ratio ($R_{oi/oe}$) to coolant surface area ratio ($R_{ci/ce}$) is preferably in a range between about 1.2 and about 5.0, more preferably between about 2.0 and about 4.0.

In certain embodiments of the invention, it is preferable for the heat exchanger to include one or more end plates for providing protection to the tubes of the heat exchanger. The end plates may be provided in various different configurations and may be substantially planar or contoured, continuous or non-continuous or otherwise configured. Additionally, the end plates may be provided as separate units that may be connected or attached to one or more of the components (e.g., the end tanks) of the heat exchanger. Alternatively, the end plates may be provided as integral with one or more of the components (e.g., the end tanks) of the heat exchanger.

Figure 4:
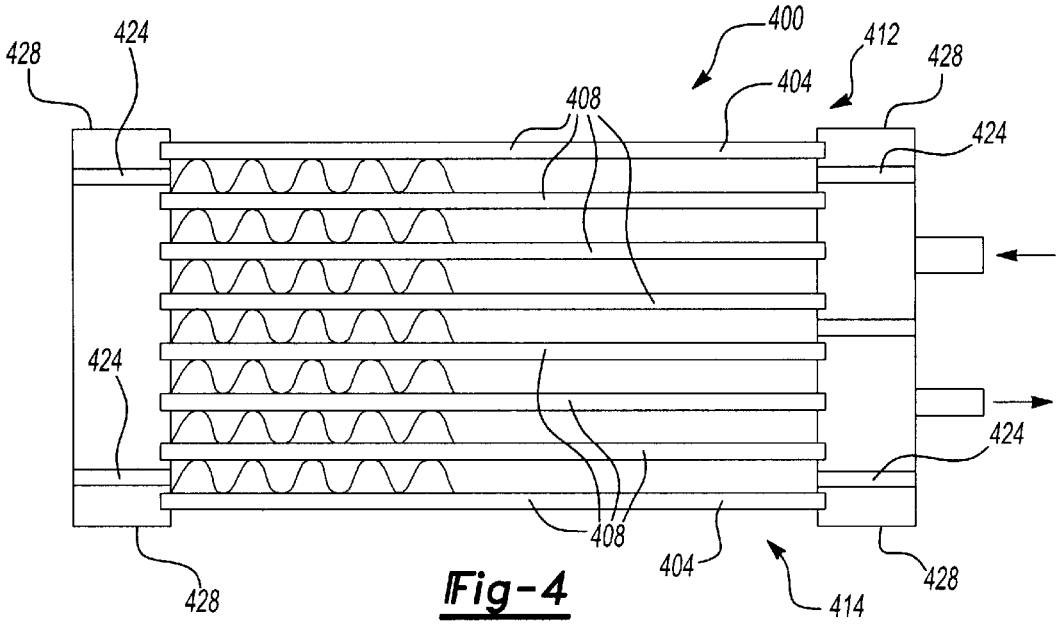
FIG. 4 is an elevational view of another exemplary heat exchanger in accordance with an aspect of the present invention.
Figure 5:
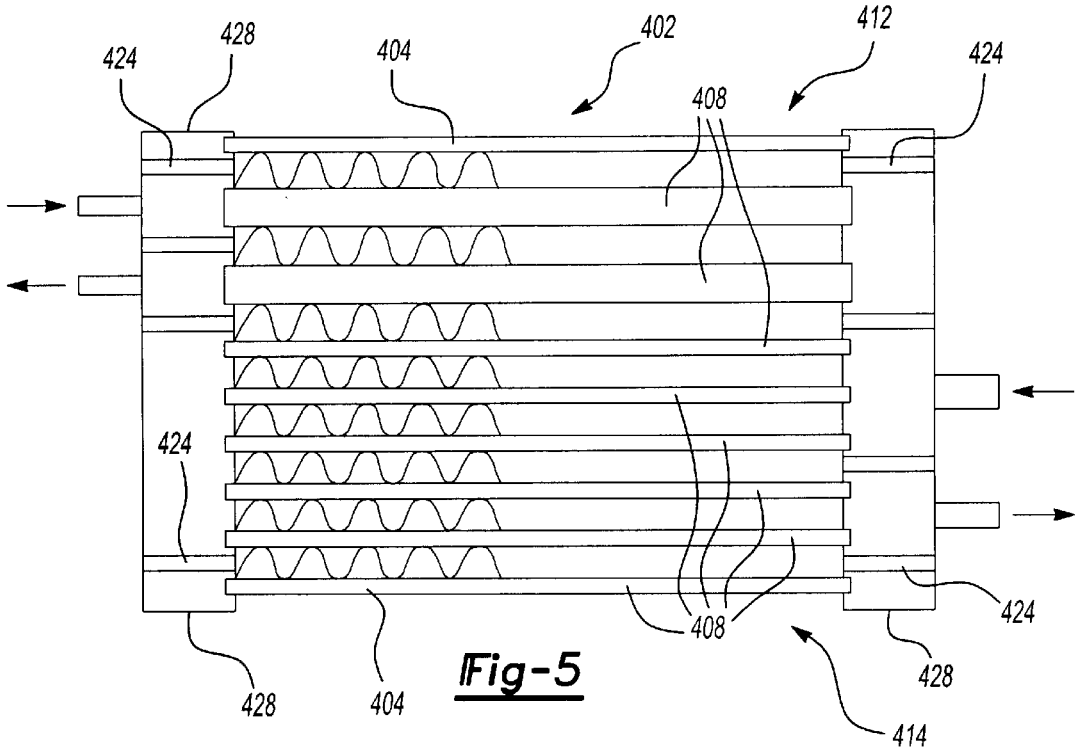
FIG. 5 is an elevational view of another exemplary heat exchanger in accordance with an aspect of the present invention.

According to one highly preferred embodiment, one or both of the end plates are omitted. The function of end plates is the end plates is provided by end tubes instead. For example, the end tubes are substantially identical to one or more of the fluid carrying tubes of the heat exchanger. Referring to FIGS. 4 and 5, there are illustrated alternative embodiments of heat exchangers 400, 402 having end tubes 404 functioning as end plates, preferably for the protection of fluid transporting tubes 408 of the heat exchangers 400, 402.

In FIG. 4, the heat exchanger 400 is a single fluid type heat exchanger and the heat exchanger 402 of FIG. 5 is a multiple fluid type heat exchanger. Each of the heat exchangers 400, 402 includes one of the end tubes 404 at each of two opposing ends 412, 414. As shown, the end tubes 404 are attached to end tanks 420 and may be restricted from fluid communication with the fluids that are to flow through the transporting tubes 408 by baffles 424 located adjacent the ends 412, 414 of the heat exchangers 400, 402. In alternative embodiments, however, it is contemplated that the end tubes 404 may be connected (e.g., welded, brazed or otherwise attached) to or connected adjacent peripheral ends 428 of the end tanks 420 such that the baffles 424 may be omitted.

Preferably, the end tubes 404 are substantially identical in size, material, and internal and external configuration to at least one and more preferably a plurality of the fluid transporting tubes 408. Advantageously, the use of substantially identical tubes as both end tubes and as the fluid supporting tubes can reduce costs of manufacturing and providing end plates for a heat exchanger. For one, no additional tooling is required for manufacture of the end tubes. Additionally, the end tubes may be assembled to the heat exchanger in the same manner as the rest of the tubes are assembled to the heat exchanger.

The invention has been illustrated herein generally by reference to a two fluid heat exchanger. However, it is not intended to be limited thereby. It is also contemplated that the inventive features are adapted for providing a three fluid heat exchanger, or even a heat exchanger for fluids in addition to three fluids. As with the two fluid exchanger preferred herein, any other multi-fluid heat exchanger preferably includes a common set of end tanks and a plurality of tubes arrayed generally parallel to each other and bridging the end tanks.

Figure 6:
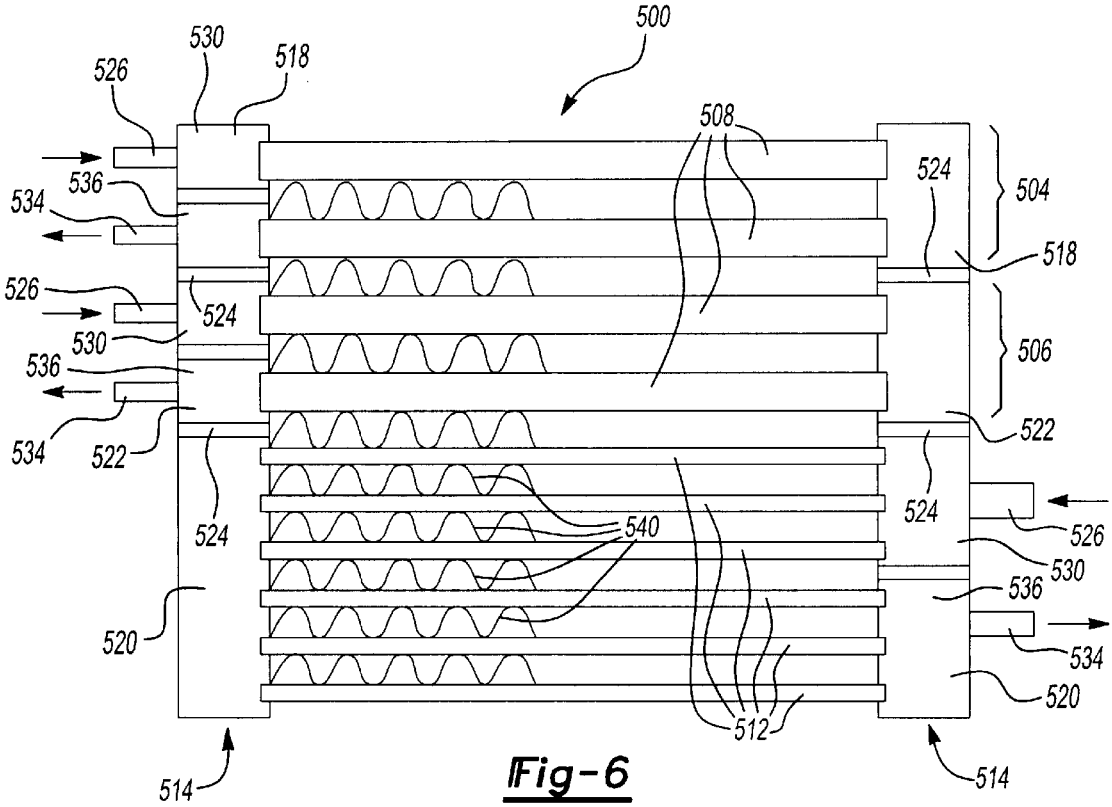
FIG. 6 is an elevational view of another exemplary heat exchanger in accordance with an aspect of the present invention.
Figure 7:
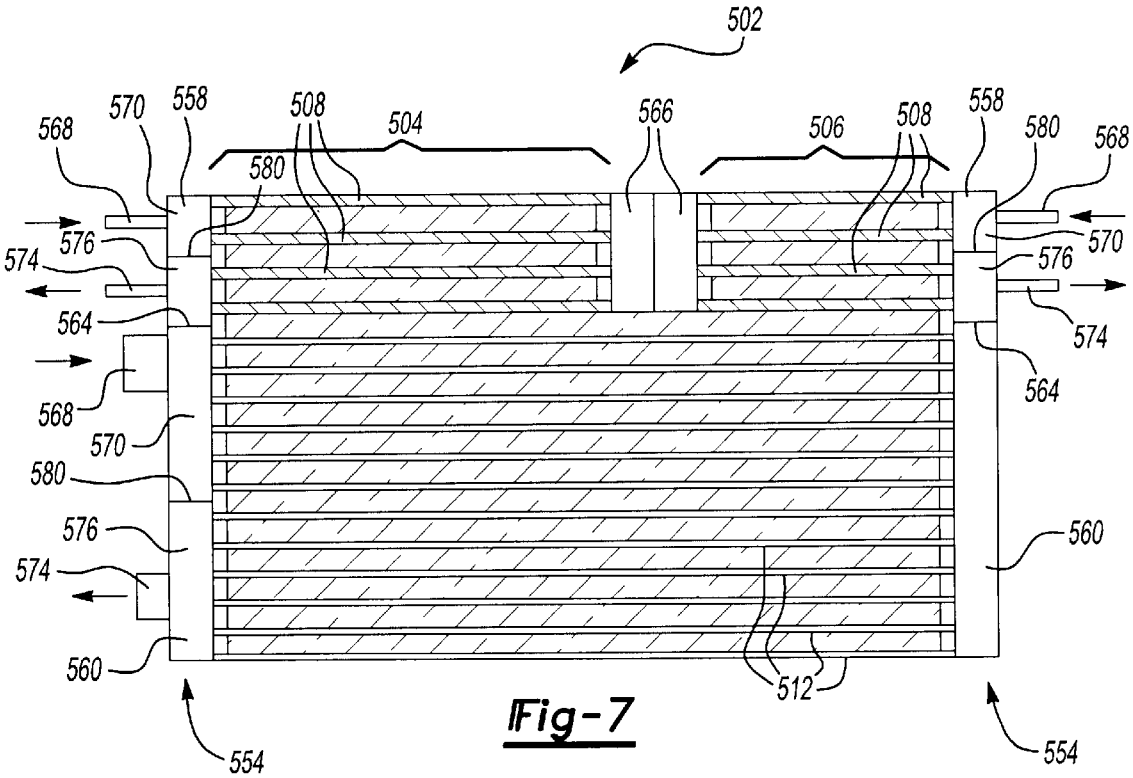
FIG. 7 is an elevational view of another exemplary heat exchanger in accordance with an aspect of the present invention.

Referring to FIGS. 6 and 7, there are illustrated triple fluid heat exchangers 500, 502 formed according to preferred embodiments of the present invention. Each of the heat exchangers 500, 502 include a first plurality 504 and second plurality 506 of larger tubes 508 and a plurality of smaller tubes 512. It should be understood that the pluralities of tubes may be arranged in a variety of configuration including side by side arrangements, stacked arrangements, combinations thereof and the like.

In FIG. 6, the heat exchanger 500 include a pair of end tanks 514 each with a first or upper portion 518, a second or lower portion 520 and a third or middle portion 522 separated from each other by baffles 524. Both the upper and middle portions 518, 522 of one of the tanks 514 include an oil inlet 526 in fluid communication with an inlet portion 530 of the upper and middle portions 518, 522 and an oil outlet 534 in fluid communication with an outlet portion 536 of the upper and middle portions 518, 522. The lower portion 520 of one of the tanks 514 includes an inlet 526 in fluid communication with an inlet portion 530 of the lower portion 520 and an outlet 534 in fluid communication with an outlet portion 536 of the lower portion 520. As shown, the inlet portions 530 and outlet portions 536 are separated from each other by baffles 524. Also, as shown, fins 540 separate the tubes 508, 512 substantially as described previously and the pluralities 504, 506 of tubes 508 are stacked atop one another. Though shown as having similar tubes for two of the heat exchangers there may be a different tube structure used for each fluid heat exchanger in the assembly.

In operation, oils and preferably two separate oils such as power steering or transmission oil flow through the inlets 526 to the inlet portions 530 of the upper and middle portions 518, 522 of their respective end tank 514. The oils then flow through at least one of the pluralities 504, 506 of tubes 508 to the upper and middle portions 518, 522 of the opposite end tank 514. Thereafter, the oils flow through at least another of the pluralities 504, 506 of tubes 508 to the outlet portions 536 of the upper and middle portions 518, 522 of the respective end tank 514 and out through the respective outlets 534. Additionally, a third fluid (e.g., a condenser fluid) flows through the inlet 526 to the inlet portion 530 of the lower portion 520 of its respective end tank 514. The third fluid then flows through at least one of the plurality of smaller tubes 512 to the lower portion 520 of the opposite end tank 514. Thereafter, the third fluid flows through at least another of the plurality of smaller tubes 512 to the outlet portion 536 of the lower portion 520 of the respective end tank 514 and out through the outlet 534.

In FIG. 7, the heat exchanger 502 include a pair of outer end tanks 554 each with a first or upper portion 558 and a second or lower portion 560 separated from each other by baffles 564. The heat exchanger 502 also includes a pair of inner end tanks 566. Both the upper and lower portions 558, 560 of one of the outer tanks 554 include an oil inlet 568 in fluid communication with an inlet portion 570 upper and lower portions 558, 560 and an oil outlet 574 in fluid communication with an outlet portion 576 of the upper and lower portions 558, 560. The upper portion 558 of one of the tanks 554 includes an inlet 568 in fluid communication with an inlet portion 570 of the upper portion 558 and an outlet 574 in fluid communication with an outlet portion 576 of the upper portion 558. As shown, the inlet portions 570 and outlet portions 576 are separated from each other by baffles 580. Also, as shown, fins 584 separate the tubes 508, 512 substantially as described previously and the pluralities 504, 506 of tubes 508 are side by side with respect to each other.

In operation, fluids and preferably two separate fluids such as power steering or transmission oil flow through the inlets 568 to the inlet portions 570 of the upper portions 558 of their respective end tanks 554. The oils then flow through at least one of the pluralities 504, 506 of tubes 508 to the inner end tanks 566. Thereafter, the oils flow through at least another of the pluralities 504, 506 of tubes 508 to the outlet portions 576 of the upper portions 558 of the respective end tanks 554 and out through the respective outlets 574. Additionally, a third fluid (e.g., a condenser fluid) flows through the inlet 568 to the inlet portion 570 of the lower portion 560 of its respective end tank 554. The third fluid then flows through at least one of the plurality of smaller tubes 512 to the lower portion 560 of the opposite end tank 554. Thereafter, the third fluid flows through at least another of the plurality of smaller tubes 512 to the outlet portion 576 of the lower portion 560 of the respective end tank 554 and out through the outlet 574.

The present invention may be further optimized by the employment of an improved passive bypass system, the employment of an improved baffle or a combination thereof.

Preferably, an exchanger in accordance with the present invention includes at least one bypass element for defining a passageway between a first stream of a fluid and a second stream of the fluid, for abbreviating the overall path that is ordinarily expected to be traveled by the fluid. For example, a first entry stream may have an ordinary flow path that would take an entering fluid through the entire tube assembly intended for such fluid. The second stream may be the exit stream of the fluid upon total or partial completion of the passage through the heat exchanger. A bypass for that fluid would result in the fluid flow path being intercepted at an intermediate location and being diverted so that the fluid need not pass entirely through the heat exchanger. Instead, it may immediately become part of the exit stream.

It will be appreciated that the incorporation of a bypass element in a multi-fluid heat exchanger is particularly attractive when the fluids to pass through the respective different portions of the heat exchanger have different flow characteristics (either from an intrinsic fluid property, as the result of an operating condition to which the fluid has been exposed or both). For example, in certain extreme operating conditions (e.g., temperatures below 0° C, or at temperatures greater than about 100° C.), the viscosity between two different types of fluids may vary considerably. At extreme temperatures, for instance, one oil may be substantially more or less viscous than another oil. It may be unnecessary for that oil to require heat exchange at or near the time of a cold engine start up. Thus, it may be desirable to be able to have that fluid bypass the normal fluid path through its entire heat exchanger, though simultaneously, another fluid may be passing through its respective heat exchanger. The present invention addresses this need by providing a bypass element, particularly a passive bypass element, and even more particularly a bypass element that employs no active structure such as a valve, actuator or electronics for controlling the bypass function.

Without intending to be bound by theory, the function of the present preferred passive bypass element is premised upon the fact that different fluids of a multi-fluid heat exchanger will have different flow characteristics, and resulting heat exchange needs. For example, a higher viscosity fluid will typically be more viscous at lower temperatures than a lower viscosity fluid. As a consequence, a relatively large pressure gradient is required for flowing the higher viscosity fluids through the tubes of the heat exchanger. The bypass element preferably is structurally configured to recognize that such a pressure gradient would ordinarily exist and to introduce a pressure gradient for flow diversion by providing the aforementioned abbreviated fluid path.

Thus, the relatively large pressure gradient to be expected in the system during normal operation, is replicated (partially or fully) by providing an alternative abbreviated flow path adapted for inducing the relatively low viscosity fluid to flow through the abbreviated flow path.

In a preferred embodiment, as the temperature of the fluid elevates (e.g., from vehicle operation), the fluid typically will become less viscous. The result will be that the pressure gradient required for flow through the heat exchanger will be lowered. As a result, the fluid that would have ordinarily sought out the bypassed flow path will have less tendency to do so. Instead it will flow through the tubes of the heat exchanger permitting for heat transfer from the fluid to occur. Thus, the bypass element passively allows more of the fluid to bypass the tubes of the heat exchanger as the fluid is more viscous, but maintains higher levels of flow through the tubes of the heat exchanger when the fluid is warmer and in need of cooling.

In certain preferred aspects of the present invention, at least one bypass element is employed to correspond to each different fluid to pass through the heat exchanger. Thus, for example, if three different fluids are to pass through their own respective portions of the heat exchanger, then there would be at least three bypass elements. Fewer bypass elements may be employed as well. For example, a bypass may be omitted from a condenser but included for one or more of the heat exchangers for additional fluids that are part of the overall heat exchanger assembly.

The bypass element may be positioned at various locations adjacent (e.g., on or near an external surface) or within the heat exchanger. The bypass is preferably located substantially, partially or entirely outside of the components of the heat exchanger It is contemplated that the bypass element may be partially or fully defined by (e.g., be integral with) the components (i.e., the end tanks, the tubes, the baffles, the fins, the inlets, the outlets or combinations thereof) of the heat exchanger. Alternatively, however, the bypass may be partially or fully defined by assemblies or members that may or may not be attached to or integrated within the components of the heat exchanger. Members or assemblies for defining the bypass may be formed of a variety of materials depending upon their location. Preferably, the members or assemblies are formed of materials compatible with (e.g. the same as) materials that form the components of the heat exchanger. One particularly preferred material is a metal such as aluminum.

Figure 8A:
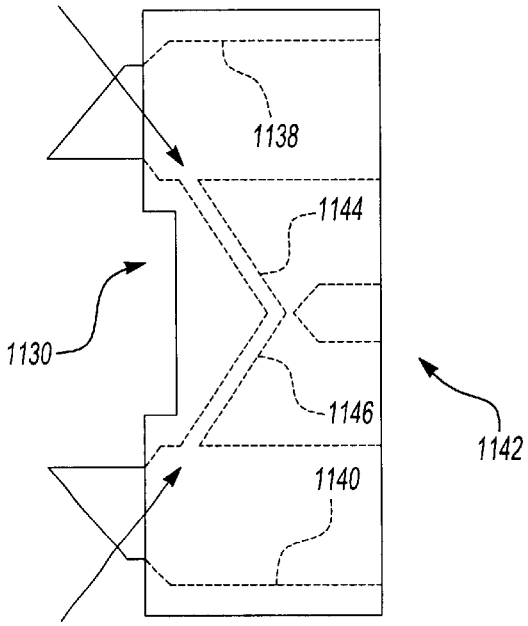
FIG. 8(A) is a sectional view of one exemplary bypass element for a heat exchanger in accordance with an aspect of the present invention.
Figure 8B:
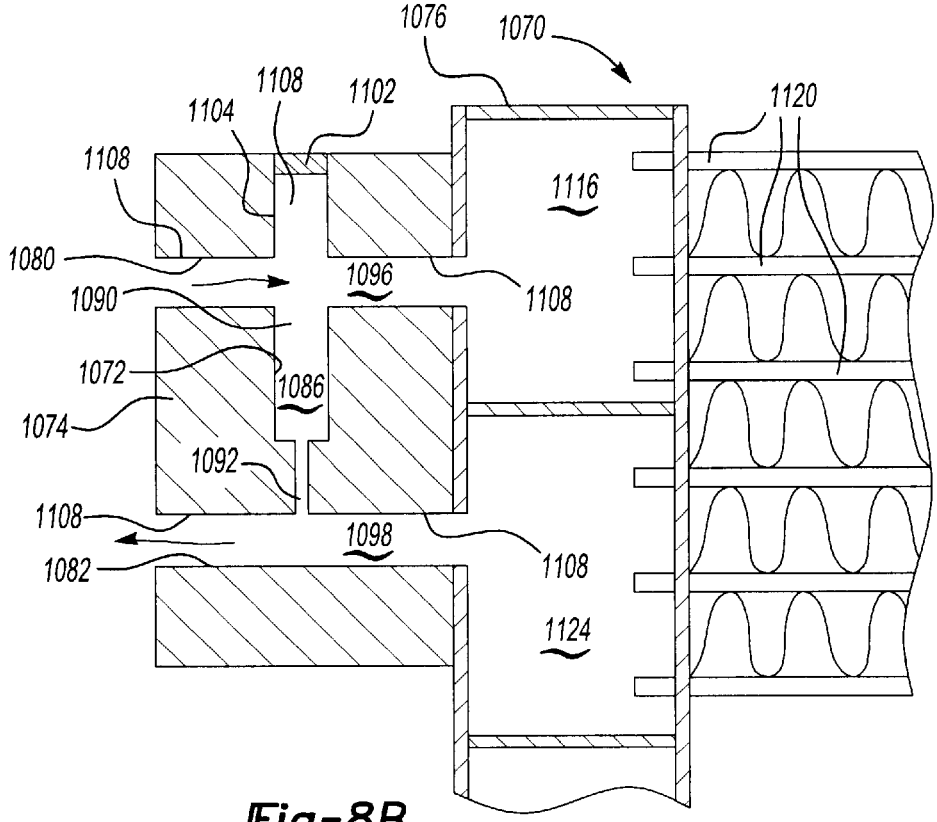
FIG. 8 is a sectional view of a portion an exemplary heat exchanger in accordance with an aspect of the present invention including a bypass.

With reference now to the drawings to illustrate in greater detail certain exemplary bypass element structures, particularly in FIG. 8, there is illustrated a portion of a heat exchanger 1070 having a bypass element 1072 that is defined by a bypass member 1074 that is attached to an end tank 1076 of the heat exchanger 1070, external of the end tank 1076. As shown, the bypass member 1074 (which is illustrated, without limitation, as generally block-shaped, but may have any suitable shape) is configured to defines an inlet 1080 to the end tank 1076 and an outlet 1082 from the end tank 1076. The bypass element 1072 provides or defines a dimensioned through-hole 1086 between the inlet 1080 and the outlet 1082 for providing an abbreviated fluid path. In the embodiment shown, though not compulsory in every instance, the through-hole 1086 is defined to include a first portion (e.g., a larger cylindrical portion 1090) and a second portion that is constricted relative to the first portion (e.g., smaller cylindrical portion 1092). In a particularly preferred embodiment, the first and second portion vary in cross sectional area so that the ratio of the cross sectional areas of the larger to the smaller portion is about 10:1 to about 1.1:1. Preferably, the smaller cylindrical portion 92 has a length (L) and a diameter (d) such that the length to diameter ratio (L/d) is between about 5 to about 20 and more preferably it ranges from 8.5 and 12.7. The bypass may include an angled flow passage that ranges between 90 degrees and 180 degrees relative to the direction of the inlet flow stream. Of course, the cross sections may vary gradually (e.g., as a funnel), or in step-wise increments as shown.

The bypass member 1074 may be formed according to a variety of techniques such as molding, machining or the like. According to the preferred embodiment shown, the member 1074 is provided as an aluminum block that is machined (e.g. drilled) to include the inlet 1080, the outlet 1082 and the through-hole 1086. According to one preferred embodiment, two through-holes 1096, 1098 are bored through one dimension (e.g., a width) of the member 1074 to form the inlet 1080 and the outlet 1082. Thereafter, the through-hole 1086 for the bypass 1072 is bored through another dimension (e.g. a length) of the member 1074 such that the bypass 1072 interconnects the through-holes 1096, 1098 of the inlet 1080 and the outlet 1082. According to this technique, it may be desirable to install a plug 1102 to close off a portion 1104 of the through-hole 1086 formed during boring of the bypass 1072. In preferred embodiments, the inlet 1080 and outlet 1082 may be formed (e.g. machined to include threaded portions 1108 at their ends for receipt of one or more connectors (not shown) between the end tank 1076 and member 1074 or between the member and inlet and outlet hoses (not shown).

In operation, and referring back to FIG. 8, the fluid, which is preferably an oil such as a transmission oil, power steering oil or the like, enters the heat exchanger 1070 through the inlet 1080 and exits through the outlet 1082. Accordingly, the fluid is faced with a choice to flow through one of two pathways from the inlet 1080 to the outlet 1082. For one of the pathways, the fluid travels through the inlet 1080 to an inlet portion 1116 of the end tank 1076 of the heat exchanger 1070, then through a plurality of tubes 1120 of the heat exchanger 1070 to an outlet portion 1124 of the end tank 1076 and out through the outlet 1082. For the other pathway, the fluid travels through a portion of inlet 1080, then through the bypass element 1072 and out through a portion of the outlet 1082. Thus, one preferred method of the present invention includes providing a multi-fluid heat exchanger for heat transfer of at least a first and a second fluid respectively through a first and second portion of the heat exchanger. The first fluid has a higher viscosity than the second fluid for a given temperature. The first fluid is passed through a passive bypass element that includes an abbreviated fluid path that obviates the need for flow of the first fluid through the first portion of the heat exchanger. The second fluid is passed through the second portion of the heat exchanger. Upon reduction of viscosity of the first fluid it flows through the first portion of the heat exchanger instead of the abbreviated fluid path.

The structure of the bypass element may vary depending upon the needs of an intended application, manufacturing constraints or the like. To illustrate, referring to FIG. 8(A), there is shown an alternative illustrate a bypass element that permits for ease of manufacture. More particularly, it is contemplated that a bypass element 1130 may be formed by a slanted cross-drilling, or by another machining or material removal process, from an inlet 1138 into an outlet 1140. Because of the drilling path chosen, this approach offers the advantage that machining of other portions of a base member 1142 that defines the bypass element 1130 need not be machined. The particular angular configuration may vary as desired, provided that the desired pressure drop for achieving the bypass function results. For example, as shown, a first opening 1144 and a second opening 1146 are drilled (e.g. symmetrically or asymmetrically) at an angle into the member 1116. Preferably, the first opening 1144 and second opening 1146 cooperatively form a passageway of the bypass 1130.

Other embodiments of bypasses are also within the scope of the present invention, including but not limited to the additional preferred embodiments that are described in the following discussion. It should be understood that principles of operation of the embodiments described in the following are substantially identical to the heat exchanger 1070 and bypass 1086 of FIG. 8, and the description of those general aspects applies also to the embodiments in the following discussion. Therefore, to avoid repetition, the description of the embodiments will focus more on unique structural features of the embodiments.

Figure 9A:
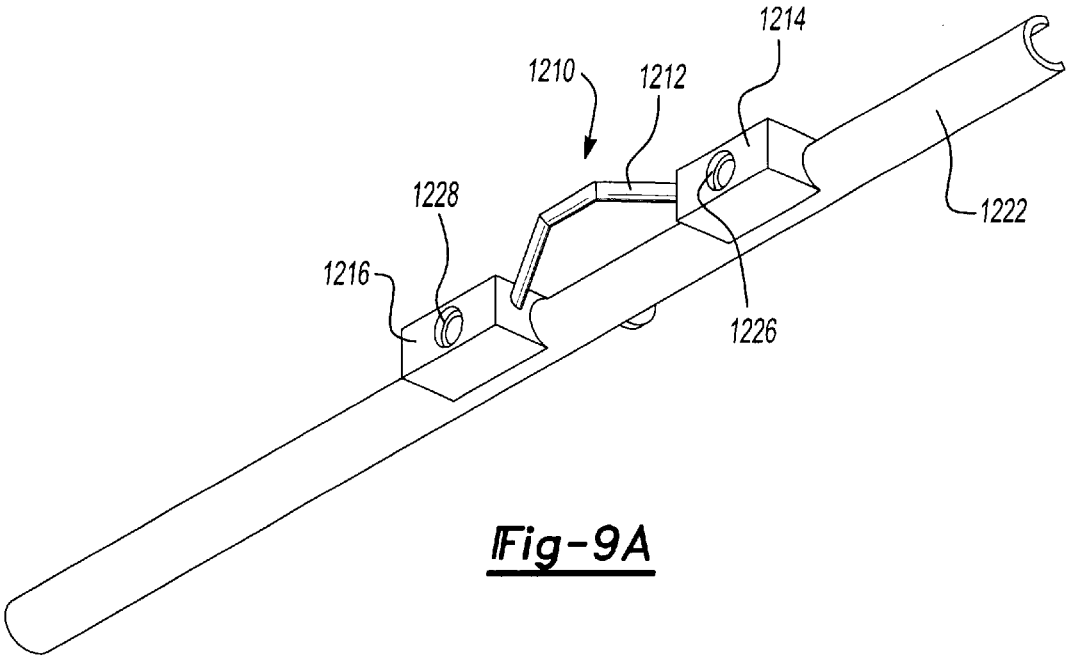
FIG. 9(A) is a perspective view of an exemplary bypass element attached to an end tank of a heat exchanger in accordance with an aspect of the present invention.
Figure 9B:
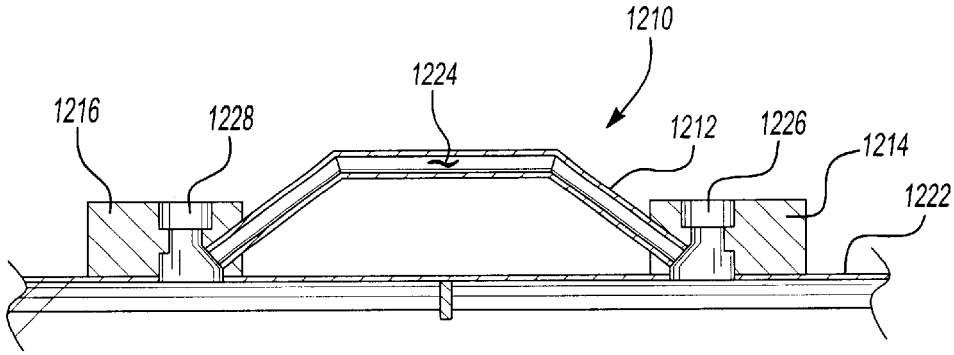
FIG. 9(B) is a side sectional view of the exemplary bypass element of FIG. 9(A)

With reference to FIGS. 9(A)–9(B), it is contemplated that the bypass element may include a tubular structure configured to an inlet and an outlet of the heat exchanger. There is illustrated a bypass element 1210 that is at least partially formed of a tubular structure 1212 that extends between an inlet 1214 and an outlet 1216. As shown, the inlet 1214 and the outlet 1216 are attached to an end tank 1222 and the tubular structure 1212 provides a passageway 1224 of the bypass element 1210 in fluid communication respectively with through-holes 1226, 1228 of the inlet 1214 and the outlet 1216.

Figure 10A:
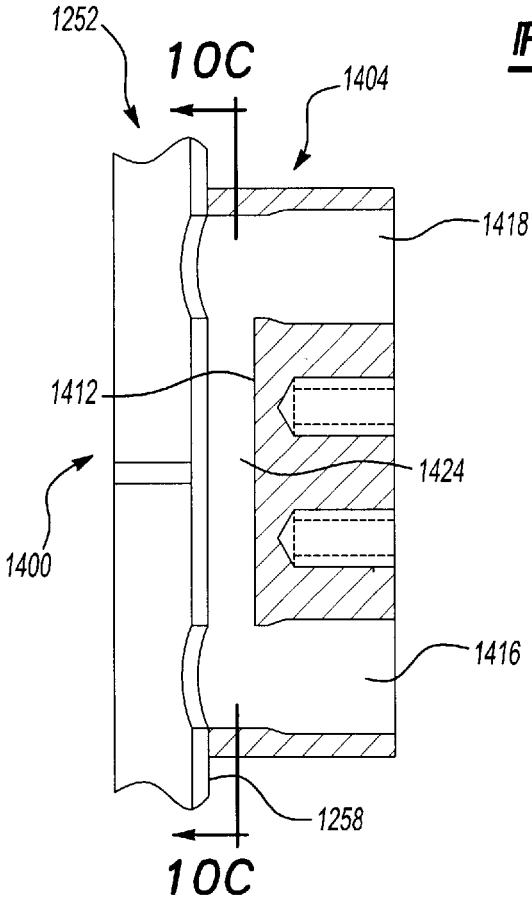
FIGS. 10(A)–10(C) respectively illustrate a side sectional, a top sectional and a front view of another exemplary bypass element in accordance with an aspect of the present invention.
Figure 10B:
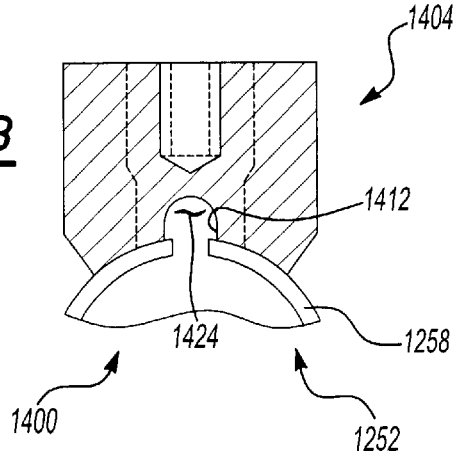
Figure 10C:
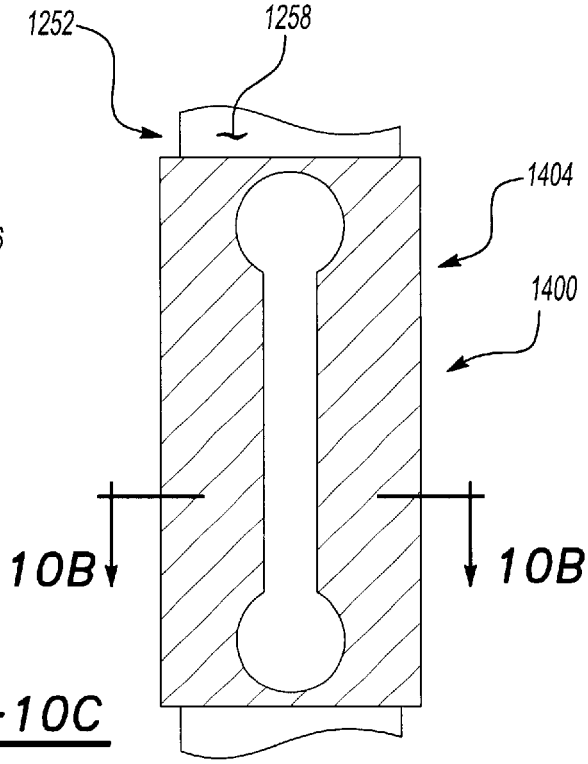

In alternative embodiments, it is contemplated that a member may be attached to a wall of a component external of a heat exchanger to cooperatively form a bypass with the wall of the component. Referring to FIGS. 10(A)–10(C), there is illustrated a bypass element 1400 formed of an end tank 1252 and a member 1404 attached (e.g., welded, brazed, fastened or the like) to a wall 1258 of the end tank 1252 external to the end tank 1252. Preferably, the member 1404 is an aluminum block with an indented portion 1412 formed in the block by machining or otherwise. According to one preferred embodiment, the indented portion 1412 of the aluminum block member 1404 is formed by milling. Preferably, the indented portion 1412 extends from an inlet 1416 to an outlet 1418 of a heat exchanger. As shown, the indentation portion 1412 and the wall 1258 of the end tank 1252 cooperatively define a passageway 1424 of the bypass element 1400 extending from the inlet 1416 to the outlet 1418.

In FIG. 8, the bypass fluid path extends substantially perpendicular to the direction of flow of the fluid through the inlet 1080. In certain highly preferred embodiments, however, it is contemplated that a heat exchanger may include a bypass element that is sloped or angled with respect to a direction of flow of the fluid for increasing or decreasing the flow of fluid that passes through the bypass. For increasing the flow, the bypass is angled, particularly at an entrance to the bypass, to extend or slope at least partially with the direction of flow of fluid through a component such as an inlet of the heat exchanger. For decreasing the flow, the bypass is angled, particularly at an entrance to the bypass, to extend or slope at least partially opposite the direction of flow of fluid through a component such as an inlet of the heat exchanger. Additionally, one or more protrusions may be placed adjacent to the entrances or exit of a bypass for increasing or decreasing flow through the bypass element. It will also be appreciated that the bypass element need not necessarily be attached directly to the end tank, but may be spaced from the end tank, external of the end tank.

Figure 11A:
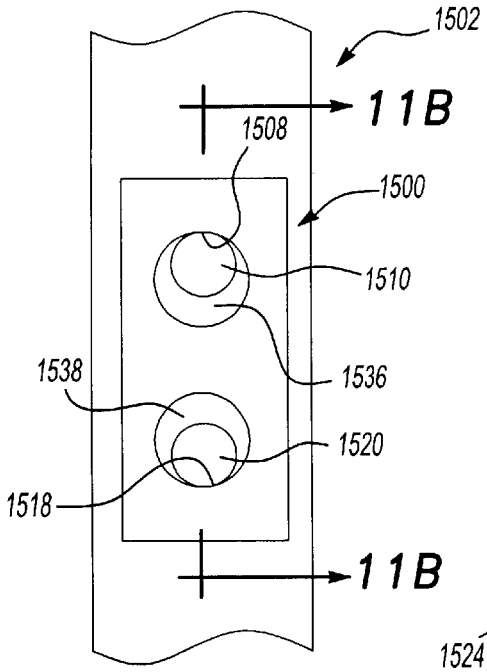
FIGS. 11(A)–11(C) respectively illustrate a front view and a pair of side sectional views of another exemplary bypass element in accordance with an aspect of the present invention.
Figure 11B:
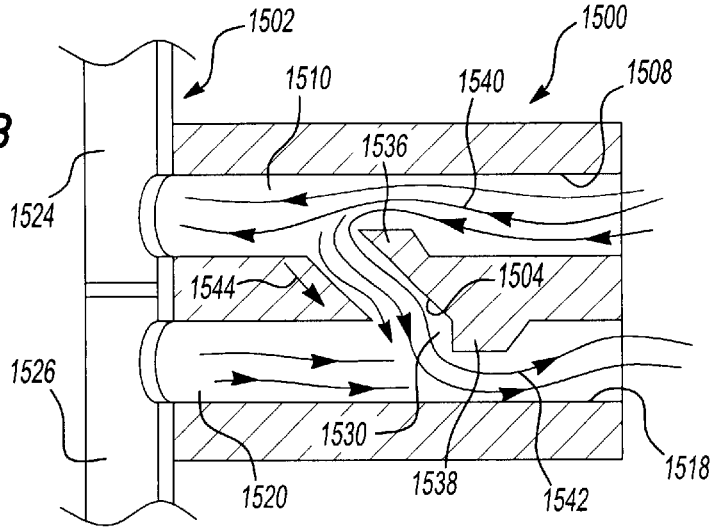

Referring to FIGS. 11(A)–11(B), there is illustrated a member 1500 attached (e.g., welded, brazed, fastened or the like) to an end tank 1502 of a heat exchanger wherein the member 1500 includes a bypass element 1504 (see FIG. 11B) that is angled for decreasing flow through the bypass element 1504. The member 1500 includes an inlet 1508 defining an inlet through-hole 1510 in fluid communication with an inlet portion 1524 of the end tank 1502 and an outlet 1518 defining an outlet through-hole 1520 in fluid communication with an outlet portion 1526 of the end tank 1502. The bypass element 1504 defines a passageway 1530 between and interconnecting the inlet 1508 and the outlet 1518 and providing fluid communication between their respective through-holes 1510, 1520. Preferably, the member 1500 supports a first protrusion 1536 extending into the through-hole 1510 of the inlet 1508 adjacent an entrance of the bypass element 1504 and a second protrusion 1538 extending into the through-hole 1520 of the outlet 1518 adjacent an exit of the bypass element 1504.

During fluid flow, a fluid flows in a first direction 1540 through the inlet 1508 and in a second direction 1542 through the outlet 1518. As shown, at least a portion of the fluid flows through the bypass 1504. Preferably, the bypass element 1504 is angled to extend or slope in a direction 1544 that is at least partially opposite the direction 1540 of flow through the inlet 1508. As shown, the portion of the fluid that flows through the bypass 1504 flows past the first protrusion 1536, then at least partially reverses direction and flows through the bypass element 1504 into the outlet 1518 and past the second protrusion 1538.

Figure 11C:
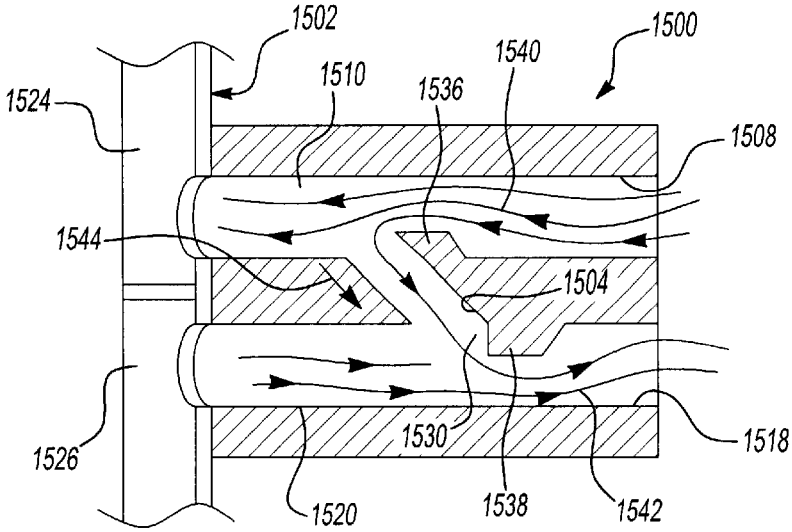

Advantageously, for embodiments where limited flow through a bypass is desired, the protrusions 1536, 1538 and the angle of the bypass fluid path can reduce the amount of flow through the bypass element 1504. In particular, the first protrusion 1536 tends to lessen the pressure at the entrance of the bypass element 1504 and the second protrusion 1536 tends to increase the pressure at the exit of the bypass element 1504 such that the pressure differential driving the fluid through the bypass element 1504 is lower resulting is less flow through the bypass element 1504. Moreover, a greater amount of pressure is required to change the direction of the fluid to send it through the angled bypass 1504, which also lessens flow through the bypass element 1504. As an added advantage, the protrusion 1536, 1538 and the angle of the fluid path within the bypass element 1504 tend to create a greater disparity between the amount of fluid flowing through the bypass when the fluid is colder (as shown in FIG. 11(B)) and the amount of fluid flowing through the bypass when the fluid is warmer (as shown in FIG. 11(C)).

In still other embodiments of the invention, it is contemplated that a heat exchanger may include one or more bypass tubes that perform the passive bypass function for the heat exchanger that was described earlier. In such embodiments, the bypass tube is typically configured such that fluid flowing through the bypass tube engages in less heat exchange than fluid flowing through other tubes of the heat exchanger (referred to herein as heat exchange tubes). As such, a hydraulic diameter of the bypass tube is typically larger than a hydraulic diameter of the heat exchange tube. Thus, a lower pressure differential is typically required to induce flow through a bypass tube as opposed to the heat exchange tube.

Figure 12A:
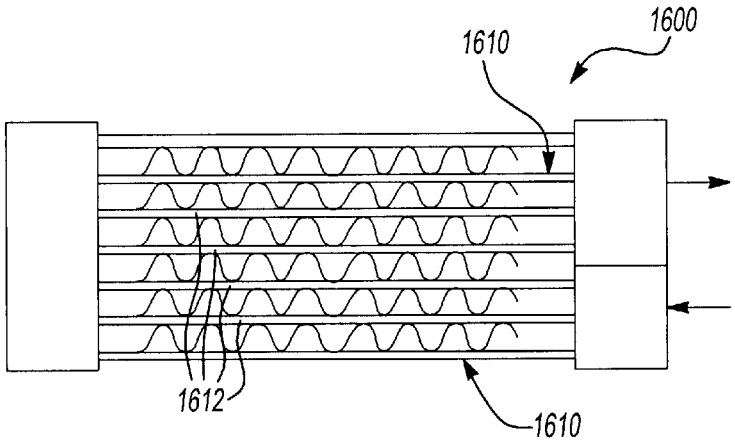
FIG. 12(A) is an elevational view of another exemplary heat exchanger according to an aspect of the present invention.
Figure 12B:
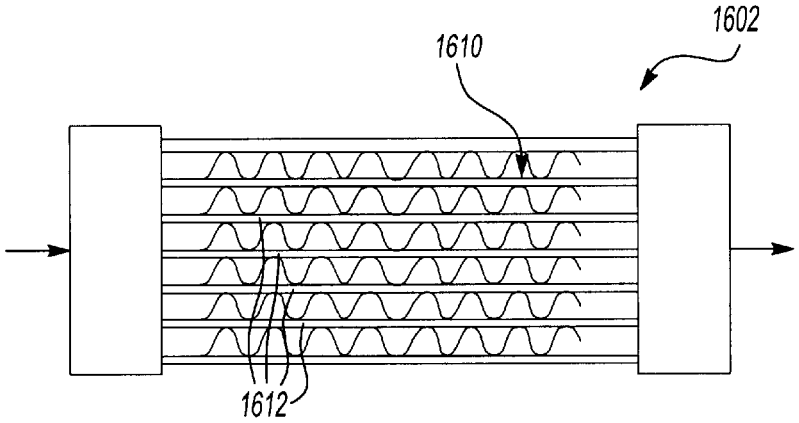
FIG. 12(B) is an elevational view of another exemplary heat exchanger according to an aspect of the present invention.

Referring to FIGS. 12(A)–12(B), there are illustrated embodiments of heat exchangers 1600, 1602 having one or more bypass tubes 1610 and one or more heat exchange tube 1612. In FIG. 12(A), the heat exchanger 1600 is a dual pass type (e.g., fluid that flows through a first tube upon entry to the heat exchanger must flow through a second tube to exit the heat exchanger). In FIG. 12(B), the heat exchanger is a single pass type (e.g., upon entry into the heat exchanger, the fluid need only pass through one tube to exit the heat exchanger).

In the preferred embodiment, the bypass tubes 1610 have a higher hydraulic diameter than the heat exchange tubes 1612. Although, the hydraulic diameter may be raised or lowered according to a variety of techniques, the bypass tubes 1610 preferably have a higher hydraulic diameter because they have fewer partitions for dividing passageways of the tubes 1610 into portions.

Figure 13:
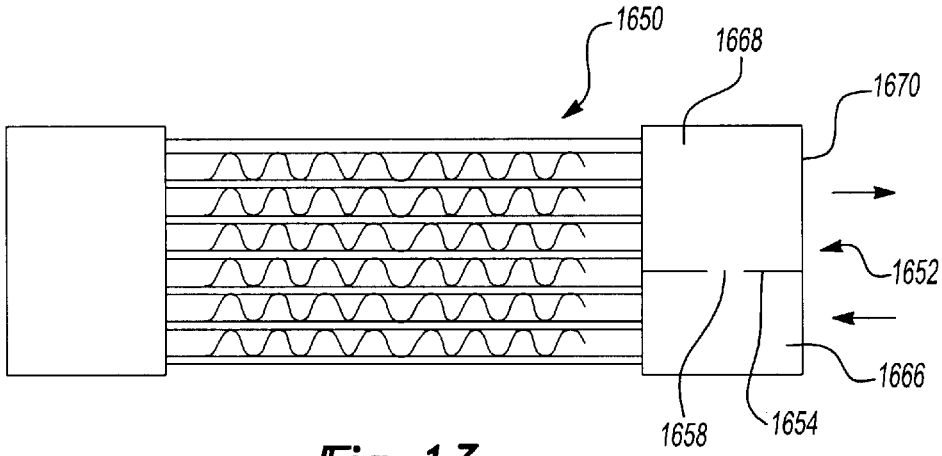
FIG. 13 is an elevational view of another exemplary heat exchanger according to an aspect of the present invention.

According to another embodiment, a bypass may be formed in a baffle of a heat exchanger. Referring to FIG. 13, there is illustrated a heat exchanger 1650 having a bypass orifice 1652 formed in a baffle 1654. As can be seen, the baffle 1654 provides a passageway 1658 of the bypass orifice 1652 wherein the passageway 1658 is in fluid communication with an inlet portion 1666 and an outlet portion 1668 of an end tank 1670 of the heat exchanger 1650.

The present invention is not intended to be limited only to the provision of a passive bypass, but may also include the use of a passive bypass in combination with an active bypass element (e.g., including a valve), an electronically controlled bypass element or both. The latter active or electronically controlled bypass elements may also be used alone.

Figure 14A:
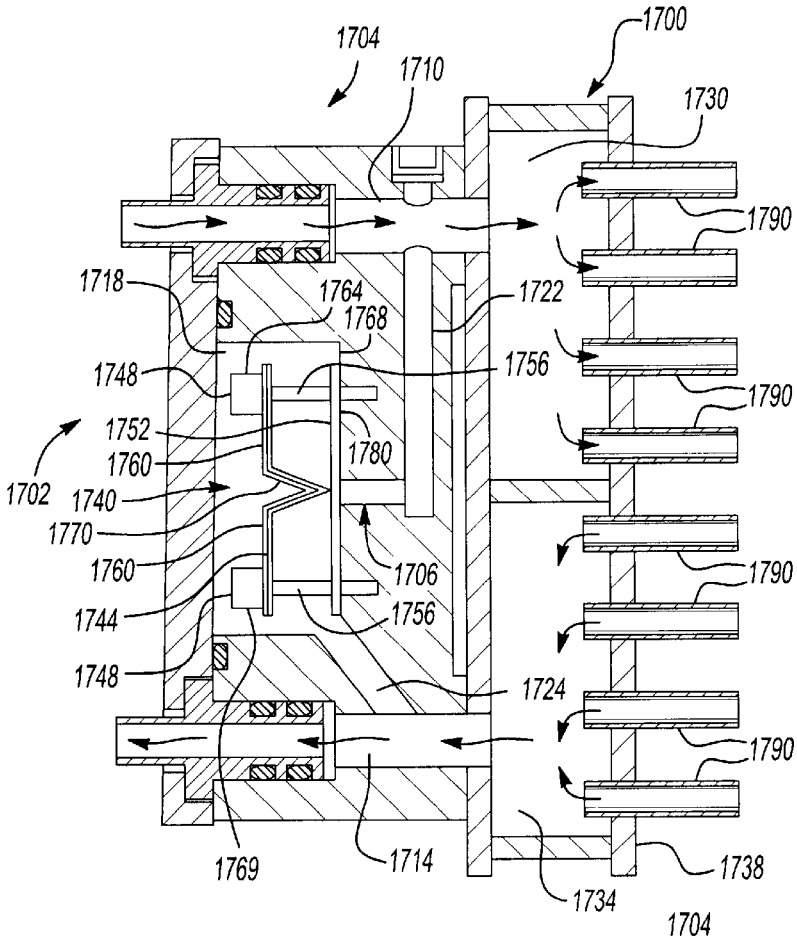
FIGS. 14(A)–14(B) are side sectional views of an exemplary bypass attached to a heat exchanger in accordance with an aspect of the present invention.
Figure 14B:
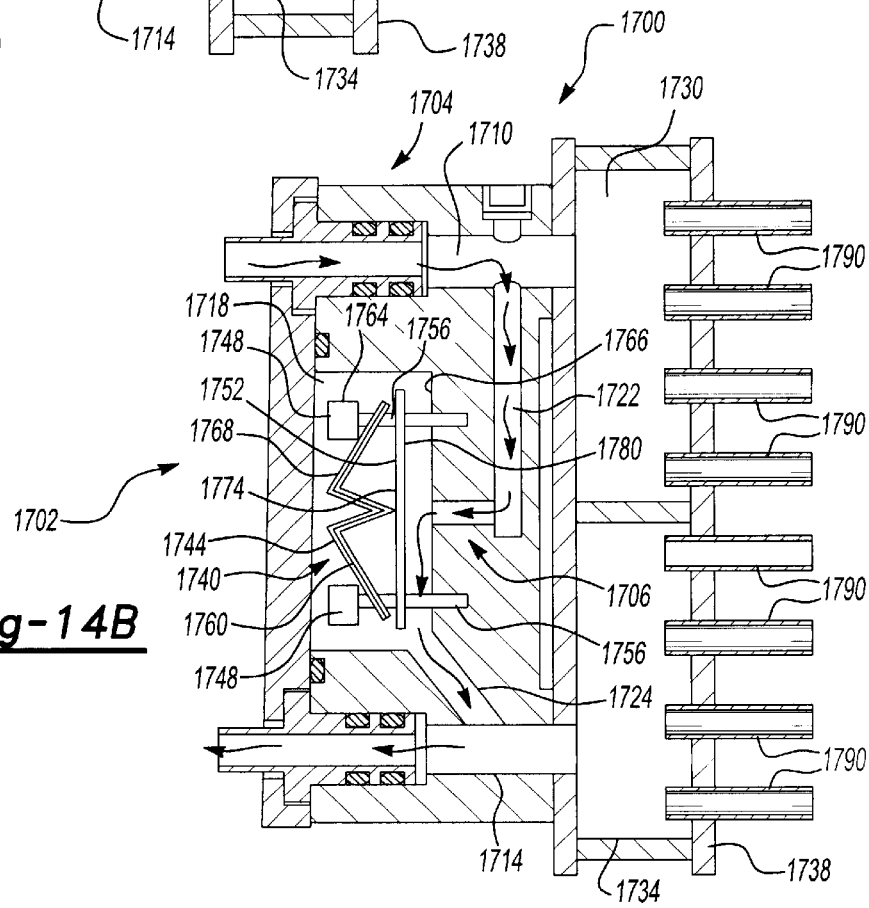

Referring to FIGS. 14(A)–14(B), there is illustrated a heat exchanger 1700 for cooling a fluid such as an oil (e.g., transmission oil, power steering oil or the like). Advantageously, the heat exchanger includes an exemplary bypass element 1702, which has the ability to substantially prohibit flow of fluid through the bypass element 1702 when the fluid temperature is relatively high, but allows the flow of fluid through the bypass element 1702 when the fluid temperature is relatively low.

In the preferred embodiment, a member 1704 (e.g., an aluminum block) is provided and the member 1704 includes a passageway 1706 in fluid communication with an inlet 1710 and an outlet 1714 of the heat exchanger 1700. As shown, the passageway 1706 includes a chamber 1718, a first through-hole 1722 and a second through-hole 1724. The first through-hole 1722 is in fluid communication with the chamber 1718 and the inlet 1710. The second through-hole 1724 is in fluid communication with the chamber 1718 and the outlet 1714.

In alternative embodiments, it is possible for the passageway 1706 to be formed according to a variety configurations. For example, through-holes of the passageway 1706 may be in fluid communication with an inlet portion 1730 and an outlet portion 1734 of an end tank 1738 of the heat exchanger 1700. In other exemplary embodiments, the chamber 1718 is excluded.

According to the preferred embodiment shown, the bypass element 1702 additionally includes an assembly 1740 located in the chamber 1718 for selectively and substantially prohibiting fluid flow through the bypass element 1702. As shown, the assembly 1740 includes an actuator 1744 attached to one or more support structures 1748 and a plug member 1752, which can be actuated via the actuator 1744 between at least a first position (shown in FIG. 14(A)) and a second position (shown in FIG. 14(B)).

In the preferred embodiment, the support structures 1748 are attached to the member 1704 and, in turn, are attached to the actuator 1744 for supporting the actuator 1744 within the chamber 1718. It is contemplated that the support structures 1748 may be provided in a variety of configurations and shapes for supporting the actuator 1744. As shown in FIGS. 14(A) and 14(B), each of the the support structures 1748 includes a body portion 1756 slidably extending through holes (not shown) in portions 1760 of the actuator 1744 and holes in the plug member 1752. Preferably, the support structures 1748 also include a cap portion 1764 for prohibiting the actuator 1744 from sliding off the body portion 1756.

Additionally, in the preferred embodiment, the actuator 1744 is biased against the member 1752 for urging the member 1752 toward a wall 1768 of the chamber 1718. It is contemplated that the actuator 1744 may be provided in a variety of configurations for biasing the member 1752. In FIGS. 14(A) and 14(B), the actuator 1744 is shown as a spring (e.g., a leaf spring) having its portions 1760 attached to the support structures 1756 such that a protruding portion 1770 of the actuator 1744 is biased against a first surface 1774 of the plug member 1752.

In operation, fluid flows through the inlet 1710 to the inlet portion 1730 of the end tank 1738. Thereafter, the fluid flows through tubes 1780 of the heat exchanger 1700 to the outlet portion 1734 of the end tank 1738 and out through the outlet 1714. For driving such flow, a pressure differential is induced between fluid flowing into the heat exchanger 1700 and fluid flowing out of the heat exchanger 1700. Typically, this pressure differential is higher when the fluid is cold as compared to the differential when the fluid is cooler. Preferably, this pressure differential is induced across the bypass 1702 as well and depending upon the magnitude of the pressure differential, at least a portion of the fluid may flow through the bypass 1702.

In particular, the actuator 1744 applies a force to the member 1752 urging a surface 1780 of the plug member 1752 against the wall 1768 of the chamber 1718. If the magnitude of the pressure differential is below a predetermined threshold value (i.e., when the fluid is warmer), the actuator 1744 maintains the surface 1780 of the plug member 1752 substantially flush against the wall 1768 of the chamber 1718 (as shown in FIG. 14(A)). In turn, the surface 1780 of the plug member 1752 covers the through-hole 1722 of the passageway 1706 and substantially prohibits flow of fluid through the bypass element 1702. However, if the magnitude of the pressure differential is above a predetermined threshold value, the pressure differential overcomes the force applied to the member 1752 by the actuator 1744 and moves the members 1752 away from the wall 1768 of the chamber 1718 allowing a substantial portion of the fluid to flow through the passageway 1706 and bypass the tubes 1790 of the heat exchanger 1700 (as shown in FIG. 14(B)). In a highly preferred embodiment, the member 1752 may include a small bleed hole (not shown) for maintaining a substantial amount of fluid in the chamber 1718 of the passageway 1706 without allowing any substantial flow through the passageway 1706.

Advantageously, the actuator 1744 may be chosen to dictate the predetermined threshold of the pressure differential depending upon the particular fluid that is to flow through the heat exchanger and depending upon the configuration of the particular heat exchanger. Moreover, a bypass element may be configured to have nearly any desired portion (e.g., all, half or the like) of the fluid flow through the bypass when the member allows fluid to flow through the bypass.

It should be appreciated that the bypass features disclosed herein have been illustrated with particular reference to their use in a multi-fluid heat exchanger. However, they also find application in single fluid heat exchangers. Accordingly, the present invention also contemplates a single fluid heat exchanger and its operation, including a bypass feature.

In one particular aspect of the present invention, it is preferable that any baffle employed be generally disk-shaped (or otherwise conforms generally with an interior of the section in which it is introduced) with a first substantially planar outwardly facing surface opposite (either in spaced or in contacting relation with) a second substantially planar outwardly facing surface. Preferably, the baffle includes a central portion and a flanged peripheral portion. The peripheral portion is preferably thicker than the central portion, exhibiting a dog bone shaped or X-shaped profile for providing a peripheral channel. The ratio of the average thickness ($t_c$) of the central portion 156 relative to the average thickness ($t_p$) of the peripheral portion 158 preferably ranges from about 0.1:1 to about 1:1, and more preferably about 0.7:1 to about 0.9:1. The ratio of the average thickness of the peripheral portion to the average diameter (or corresponding cross sectional dimension) of an end tank or other structure into which it is introduced, at the desired baffle site, is about 1:3 to about 1:7, and more preferably is about 1:5.

Though other baffles may be employed, it is preferred to employ this type of baffle as it affords flexibility in mounting and helps to assure that the presence of dead tubes or other tube inefficiencies can be avoided.

Another preferred baffle is adapted for providing leak detection or for otherwise assuring seal integrity. In this approach, the peripheral channel of a baffle is substantially juxtaposed with an aperture in an end tank, and also preferably juxtaposed with a space between tubes. Any fluid indicative of a leak will enter the channel and exit the end tank aperture.

Unless stated otherwise, dimensions and geometries of the various structures depicted herein are not intended to be restictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A heat exchanger comprising:

a first end tank;

a second end tank opposite the first end tank;

a plurality of first tubes in fluid communication with the first and second end tanks, the plurality of first tubes adapted to have a first fluid flow therethrough;

a plurality of second tubes in fluid communication with the first and second end tanks, the plurality of second tubes adapted to have a second fluid, different from the first fluid, flow therethrough, wherein at least one of the plurality of second tubes has an internal passageway defined by at least one surface and the at least one surface is corrugated to include several patterned ridges; and a plurality of fins disposed between the first and second tubes, with the first and second tubes and the fins being generally co-planar relative to each other.

2. A heat exchanger as in claim 1 wherein the first end tank and the second end tank each include at least one baffle.

3. A heat exchanger as in claim 1 wherein the first tubes are larger than the second tubes.

4. A heat exchanger as in claim 1 wherein the first fluid is an oil and the second fluid is a refrigerant.

5. A heat exchanger as in claim 1 wherein the internal passageway is subdivided into a plurality of sub-passageways.

6. A heat exchanger as in claim 1 wherein each of the plurality of first tubes includes a passageway and the passageway includes partitions, which divide the passageway into at least one larger sub-passageway and at least one smaller sub-passageway such that the tube will perform a passive bypass function.

7. A heat exchanger as in claim 6 wherein the partitions include fins.

8. A heat exchanger comprising:

a first end tank;

a second end tank opposite the first end tank;

a plurality of first extruded metal tubes in fluid communication with the first and second end tanks, and being adapted to have a first fluid flow there-through;

a plurality of second extruded metal tubes in fluid communication with the first and second end tanks, and being adapted to have a second fluid, different from the first fluid, flow there-through; and a plurality of fins disposed between the first and second tubes, with the first and second tubes and the fins being generally co-planar relative to each other;

wherein at least one of the first or second extruded metal tubes includes an interior wall structure including a partition adapted for subdividing the tube into a plurality of passageways within the tube, the partition including at least one fin; and wherein the interior wall structure is corrugated.

9. A heat exchanger as in claim 8 wherein the first end tank and the second end tank each include at least one baffle.

10. A heat exchanger as in claim 8 wherein the first tubes are larger than the second tubes.

11. A heat exchanger as in claim 8 wherein at least one of the plurality of passageways is stacked atop another of the plurality of passageways.

12. A heat exchanger as in claim 8 wherein at least one of the plurality of passageways is larger than another of the plurality of passageways for performing a passive bypass function.

13. A heat exchanger as in claim 8 wherein an insert is located in at least one of the plurality of passageways.

14. A heat exchanger for an automotive vehicle, comprising:

at least one end tank; and at least three heat exchangers including a plurality of spaced apart metal tubes with fins between the spaced tubes;

the heat exchangers being disposed so that their respective tubes and fins are generally co-planar with each other and are connected to the at least one end tank;

the heat exchangers being selected from the group consisting of an oil heat exchanger, a condenser or combinations thereof;

wherein the plurality of spaced apart metal tubes have a length and a hydraulic diameter and wherein a ratio of the length to the hydraulic diameter is between about 80 and about 1820.

15. A heat exchanger as in claim 14 wherein the at least one end tank includes at least one baffle.

16. A heat exchanger as in claim 14 wherein the ration of the oil cooler internal to external surface area is larger than the ratio of the condenser internal to external surface area.

17. A heat exchanger as in claim 14 wherein the length is between about 200 mm to about 1000 mm and the hydraulic diameter is between about 0.55 to about 2.50 mm.

18. A heat exchanger as in claim 14 wherein the at least one end tank includes a plurality of end tanks.

19. A heat exchanger as in claim 14 wherein at least one of the at least three heat exchangers includes a tube having an internal passageway defined by at least one surface and the at least one surface is corrugated.

20. A heat exchanger as in claim 19 wherein the at least one surface is corrugated to include several patterned ridges.

21. A heat exchanger as in claim 19 wherein the internal passageway is subdivided into a plurality of sub-passageways.

22. A heat exchanger for an automotive vehicle, comprising:

a first heat exchanger;

a second heat exchanger in generally co-planar relationship with the first heat exchanger;

at least one end tank divided into an inlet portion and an outlet portion for the first heat exchanger, and being connected in fluid communication to both the first heat exchanger and the second heat exchanger;

an inlet in fluid communication with the inlet portion of the first end tank;

an outlet in fluid communication with the outlet portion of the first end tank;

a plurality of heat exchanger tubes adapted for fluid flow therethrough in a first flow circuit in the first heat exchanger, at least one of the plurality of tubes in fluid communication with the inlet portion and a least one other of the plurality of tubes in fluid communication with the outlet portion; and a bypass element located on the exterior of the end tank and being adapted for providing a passageway at an intermediate location within the first flow circuit adapted for, at relatively low operating temperatures, intercepting a fluid in the first flow circuit to divert the fluid so that it avoids passing through the entire first flow circuit.

23. A heat exchanger as in claim 22 wherein the inlet, the outlet and the passageway of the bypass element are defined by a single member and the passageway provides fluid communication between the inlet and the outlet.

24. A heat exchanger as in claim 23 wherein the fluid flows through the inlet in a first direction and the passageway of the bypass element extends at least partially in a second direction opposite the first direction.

25. A heat exchanger as in claim 22 wherein the first heat exchanger is for an oil and the second heat exchanger is a condenser.

26. A heat exchanger as in claim 22 wherein the at least one end tank includes an X-shaped baffle.

27. A heat exchanger as in claim 22 wherein the bypass element includes a member and an actuator for selectively moving the member to substantially prohibit the fluid from flowing through the passageway of the bypass element.

28. A heat exchanger as in claim 27 wherein the actuator is a spring that applies a force to the member for prohibiting the fluid from flowing through the bypass element and wherein said force can be overcome by a pressure gradient that can be induced across the bypass when the fluid is relatively cool.

29. A heat exchanger for an automotive vehicle, comprising:

a first heat exchanger;

a second heat exchanger in generally co-planar relationship with the first heat exchanger;

at least one end tank divided into an inlet portion and an outlet portion for the first heat exchanger, and being connected in fluid communication to both the first heat exchanger and the second heat exchanger;

an inlet in fluid communication with the inlet portion of the first end tank;

an outlet in fluid communication with the outlet portion of the first end tank;

a plurality of heat exchanger tubes adapted for fluid flow therethrough in a first flow circuit in the first heat exchanger, at least one of the plurality of tubes in fluid communication with the inlet portion and a least one other of the plurality of tubes in fluid communication with the outlet portion;

a bypass element located on the exterior of the end tank and being adapted for providing a passageway at an intermediate location within the first flow circuit adapted for inducing a pressure gradient, at relatively low operating temperatures, and intercepting a fluid in the first flow circuit to divert the fluid so that it avoids passing through the entire first flow circuit, wherein the bypass element includes a first passageway that is part of the inlet, and a second passageway that is part of the outlet, and a third passageway joining the first passageway and the second passageway.

30. A heat exchanger as in claim 29 wherein the first passageway, the second passageway and the third passageway of the bypass element are defined by a single member and the passageway provides fluid communication between the inlet and the outlet.

31. A heat exchanger as in claim 29 wherein the fluid flows through the inlet in a first direction and the third passageway of the bypass element extends at least partially in a second direction opposite the first direction.

32. A heat exchanger as in claim 29 wherein the first heat exchanger is for an oil and the second heat exchanger is a condenser.

33. A heat exchanger as in claim 29 wherein the at least one end tank includes an X-shaped baffle.

34. A heat exchanger as in claim 29 wherein the bypass element includes a member and an actuator for selectively moving the member to substantially prohibit the fluid from flowing through the third passageway of the bypass element.

35. A heat exchanger as in claim 34 wherein the actuator is a spring that applies a force to the member for prohibiting the fluid from flowing through the bypass element and wherein said force can be overcome by the pressure gradient that can be induced across the bypass when the fluid is relatively cool.

36. A heat exchanger for an automotive vehicle, comprising:

a first heat exchanger;

a second heat exchanger in generally co-planar relationship with the first heat exchanger;

at least one end tank divided into an inlet portion and an outlet portion for the first heat exchanger, and being connected in fluid communication to both the first heat exchanger and the second heat exchanger;

an inlet in fluid communication with the inlet portion of the first end tank;

an outlet in fluid communication with the outlet portion of the first end tank;

a plurality of heat exchanger tubes adapted for fluid flow therethrough in a first flow circuit of the first heat exchanger, at least one of the plurality of tubes in fluid communication with the inlet portion and a least one other of the plurality of tubes in fluid communication with the outlet portion;

a bypass element located on the exterior of the end tank and being adapted for providing a passageway at an intermediate location within the first flow circuit adapted for inducing a first pressure gradient, at relatively low operating temperatures, and intercepting a fluid in the first flow circuit to divert the fluid so that it avoids passing through the entire first flow circuit, wherein the bypass element includes a first passageway that is part of the inlet, and a second passageway that is part of the outlet, and a third passageway joining the first passageway and the second passageway; and further wherein, a protrusion is provided in the first passageway for inducing a second pressure gradient at the juncture of the first passageway and the third passageway.

37. A heat exchanger as in claim 36 wherein the first passageway, the second passageway and the third passageway of the bypass element are defined by a single member and the passageway provides fluid communication between the inlet and the outlet.

38. A heat exchanger as in claim 36 wherein the fluid flows through the inlet in a first direction and the third passageway of the bypass element extends at least partially in a second direction opposite the first direction.

39. A heat exchanger as in claim 36 wherein the at least one end tank includes an X-shaped baffle.

40. A heat exchanger as in claim 36 wherein the bypass element includes a member and an actuator for selectively moving the member to substantially prohibit the fluid from flowing through the third passageway of the bypass element.

41. A heat exchanger as in claim 40 wherein the actuator is a spring that applies a force to the member for prohibiting the fluid from flowing through the bypass element and wherein said force can be overcome by the pressure gradient that can be induced across the bypass when the fluid is relatively cool.

42. A heat exchanger comprising:

a first end tank;

a second end tank opposite the first end tank;

a plurality of first tubes in fluid communication with the first and second end tanks, the plurality of first tubes adapted to have a first fluid flow therethrough;

a plurality of second tubes in fluid communication with the first and second end tanks, the plurality of second tubes adapted to have a second fluid, different from the first fluid, flow therethrough, wherein at least one of the plurality of second tubes has an internal passageway defined by at least one surface and the at least one surface is corrugated; and a plurality of fins disposed between the first and second tubes, with the first and second tubes and the fins being generally co-planar relative to each other wherein each of the plurality of first tubes includes a passageway and the passageway includes partitions, which divide the passageway into at least one larger sub-passageway and at least one smaller sub-passageway such that the tube will perform a passive bypass function.

43. A heat exchanger as in claim 42 further comprising a bypass element located on the exterior of the first end tank or the second end tank.

44. A heat exchanger as in claim 42 wherein the at least one surface is corrugated to include several patterned ridges.

45. A heat exchanger as in claim 42 wherein at least one of the first fluid and the second fluid is an oil and at least one of the first fluid and second fluid is a refrigerant.

46. A heat exchanger as in claim 42 wherein the first tubes are larger than the second tubes.

47. A heat exchanger comprising:

a first end tank;

a second end tank opposite the first end tank;

a plurality of first extruded metal tubes in fluid communication with the first and second end tanks, and being adapted to have a first fluid flow there-through;

a plurality of second extruded metal tubes in fluid communication with the first and second end tanks, and being adapted to have a second fluid, different from the first fluid, flow there-through; and a plurality of fins disposed between the first and second tubes, with the first and second tubes and the fins being generally co-planar relative to each other;

wherein at least one of the first or second extruded metal tubes includes an interior wall structure including a partition adapted for subdividing the tube into a plurality of passageways within the tube;

wherein at least one of the plurality of passageways is stacked atop another of the plurality of passageways; and wherein the interior wall structure is corrugated.

48. A heat exchanger as in claim 47 further comprising a bypass element located on the exterior of the first end tank or the second end tank.

49. A heat exchanger as in claim 47 wherein the interior wall structure is corrugated to include several patterned ridges.

50. A heat exchanger as in claim 47 wherein at least one of the first fluid and the second fluid is an oil and at least one of the first fluid and second fluid is a refrigerant.

51. A heat exchanger as in claim 47 wherein the first tubes are larger than the second tubes.

* * * * *

UNITED STATES PATENT AND TRADEMARK OFFICE

CERTIFICATE OF CORRECTION

PATENT NO. : 6,793,012 B2
DATED : September 21, 2004
INVENTOR(S) : Lei Fang et al.

It is certified that error appears in the above-identified patent and that said Letters Patent is hereby corrected as shown below:

Column 22,
Line 53, replace “first tubes” with -- second tubes --.
Line 54, replace “second tubes” with -- first tubes --.
Line 55, replace “first fluid” with -- second fluid --.
Line 56, replace “second fluid” with -- first fluid --.

Signed and Sealed this

Eighth Day of March, 2005

JON W. DUDAS
*Director of the United States Patent and Trademark Office*